US008056382B2

(12) United States Patent
Cooke

(10) Patent No.: US 8,056,382 B2
(45) Date of Patent: Nov. 15, 2011

(54) APPARATUS AND METHOD FOR CURVING METAL PANELS

(75) Inventor: Jason S. Cooke, Jacksboro, TN (US)

(73) Assignee: CRU Concepts, LLC, Snellville, GA (US)

( * ) Notice: Subject to any disclaimer, the term of this patent is extended or adjusted under 35 U.S.C. 154(b) by 903 days.

(21) Appl. No.: 12/028,473

(22) Filed: Feb. 8, 2008

(65) Prior Publication Data

US 2008/0216540 A1 Sep. 11, 2008

Related U.S. Application Data

(60) Provisional application No. 60/888,889, filed on Feb. 8, 2007.

(51) Int. Cl.
*B21D 5/14* (2006.01)

(52) U.S. Cl. ..... 72/166; 72/173

(58) Field of Classification Search ..... 72/166, 72/167, 169–175, 178, 182, 224, 225, 250
See application file for complete search history.

(56) References Cited

U.S. PATENT DOCUMENTS

| | | | |
|---|---|---|---|
| 3,111,788 | A | 11/1963 | Ouellet |
| 3,173,225 | A | 3/1965 | Goodwill et al. |
| 3,664,170 | A | 5/1972 | Davis |
| 3,831,419 | A | 8/1974 | Leese et al. |
| 3,902,288 | A | 9/1975 | Knudson |
| 4,050,277 | A | 9/1977 | Malott et al. |
| 4,154,077 | A | 5/1979 | Cotter |
| 4,505,143 | A | 3/1985 | Knudson |
| 4,599,771 | A | 7/1986 | Trenkler et al. |
| 4,864,837 | A | 9/1989 | Fielden, Jr. |
| 5,359,871 | A | 11/1994 | Morello |
| 5,664,451 | A | 9/1997 | Schultz |
| RE38,064 | E | 4/2003 | Morello |
| 6,843,092 | B2 | 1/2005 | Greenberg et al. |
| 2003/0094027 | A1 | 5/2003 | Cunningham |
| 2003/0136166 | A1 | 7/2003 | Greenberg et al. |

OTHER PUBLICATIONS

Metal Construction Association; Oil Canning; Technical Bulletin #95-1060; Jan. 2003.
United States Steel Corporation; Roll-Forming Guide for Building Panels; 2004; pp. 1-15.
Search Report and Written Opinion for International Patent Application No. PCT/US2008/053454; Jul. 25, 2008.
Supplemental Search Report and Written Opinion for International Patent Application No. PCT/US2008/053454; Sep. 9, 2008.

*Primary Examiner* — Debra Sullivan
(74) *Attorney, Agent, or Firm* — Jason A. Bernstein; Barnes & Thornburg LLP

(57) ABSTRACT

The pressures provided by several wheels or rollers (18, 20, 22, 24, 30, 32) on various members of a metal panel are controlled to produce a curved panel of desired radius with little or no distortion. Predetermined pressures are used to achieve the desired curvature and increased pressures provide smaller radii of curvature. For metal "U" panels pressure is preferably applied on two members. For seamed metal panels pressure is preferably applied on three members. Additional curvature may be obtained by use of a curving bar (82). Motors (34, 36, 38) drive the wheels, which urge these panel members through the wheels, the wheels having a separation distance less than the original thickness of the metal. This results in the metal of those members being elongated, thereby curving the panel with little or no distortion. Repeatable results are also provided.

20 Claims, 22 Drawing Sheets

FIG.23
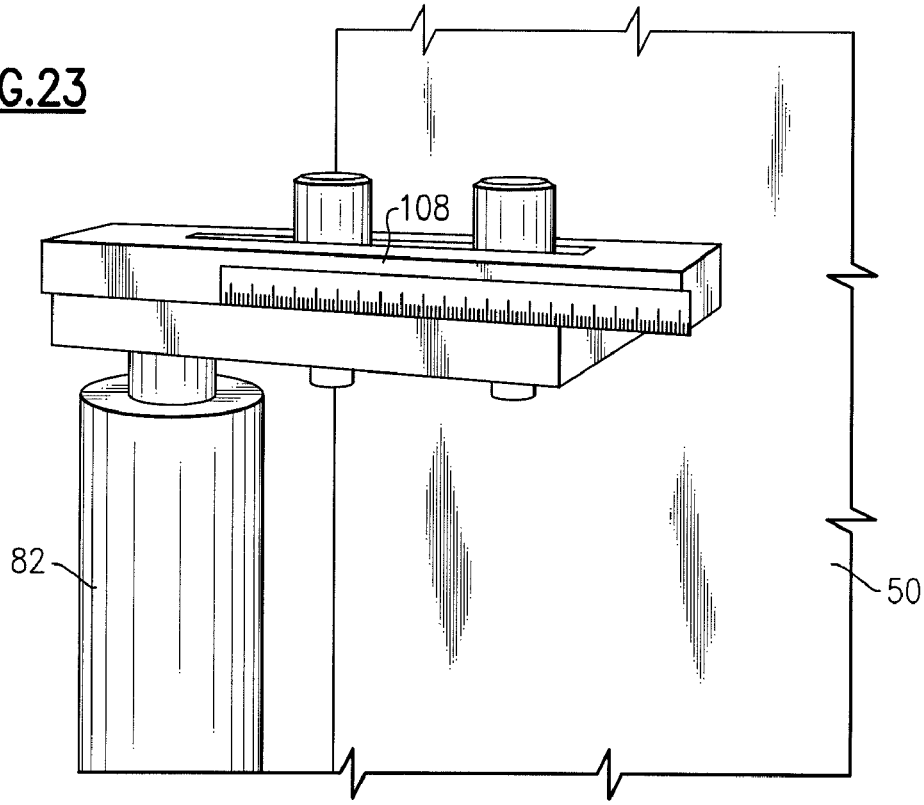
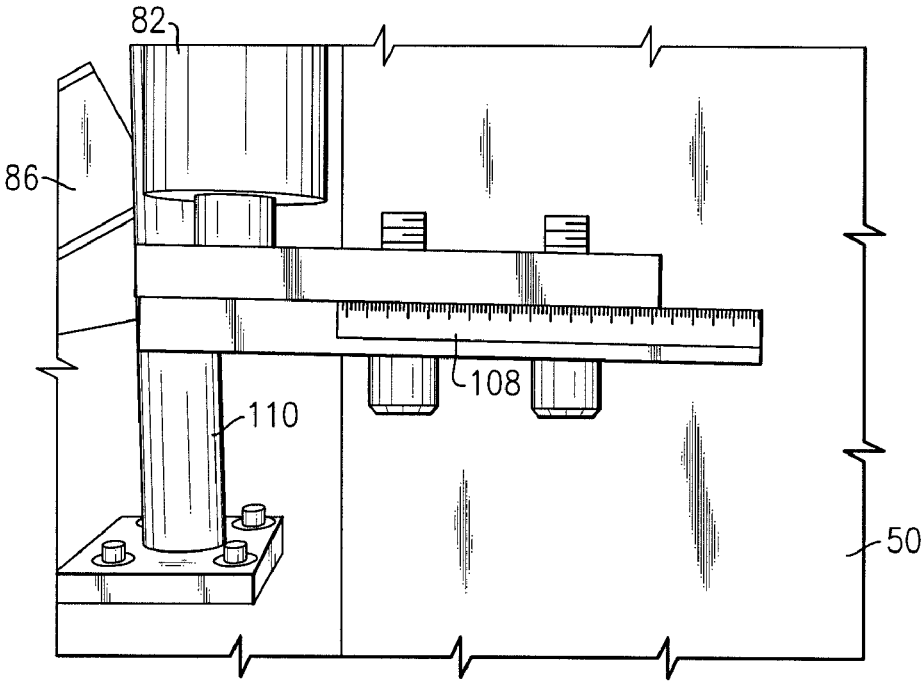
FIG.24

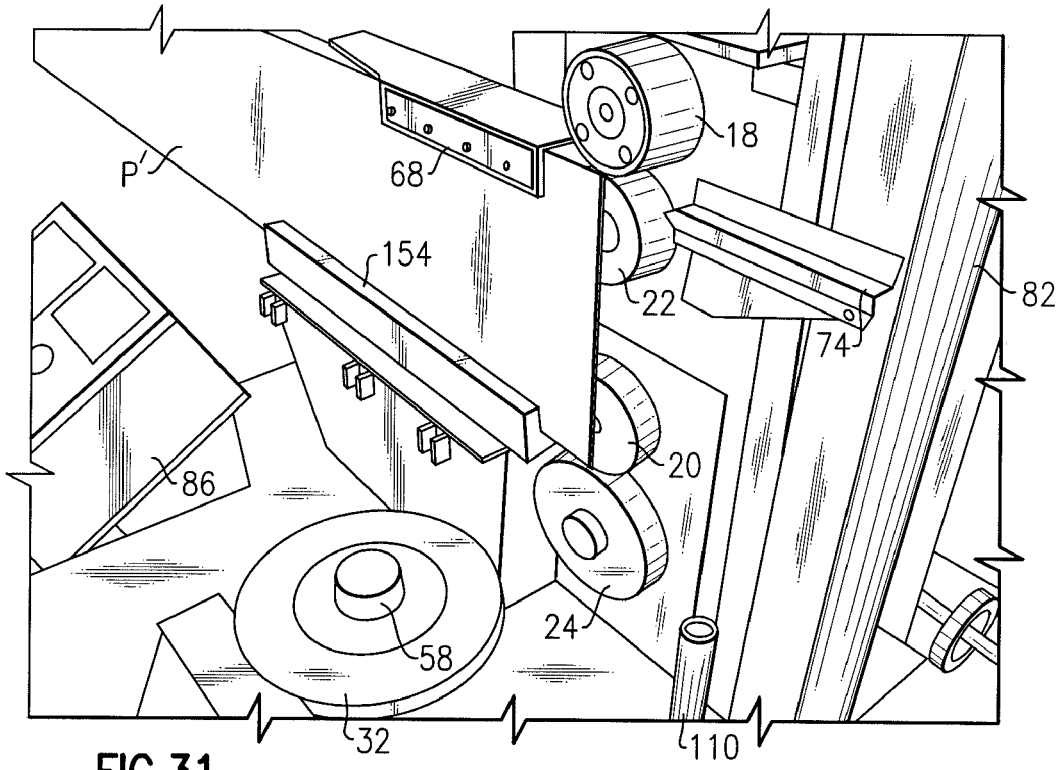
FIG.31
FIG.32
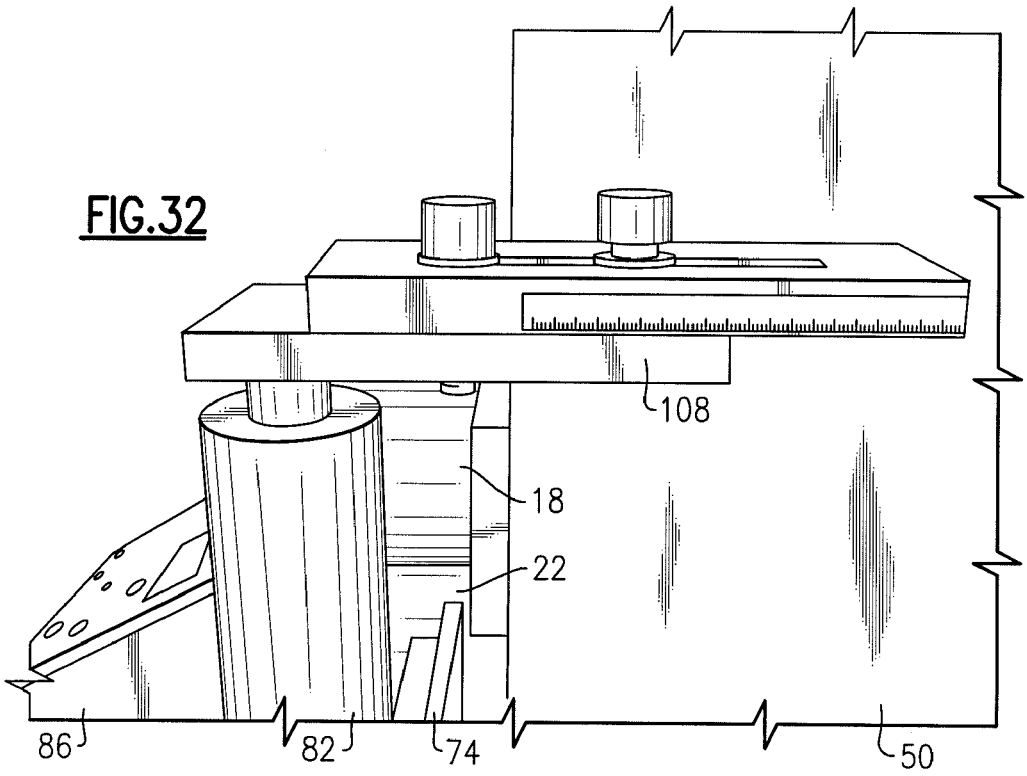

FIG.35
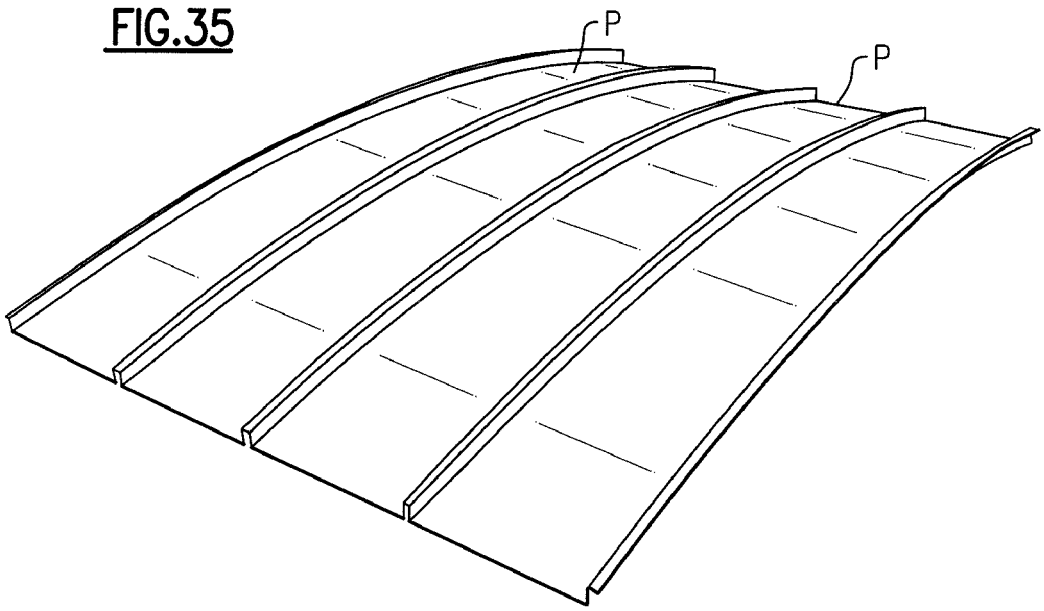
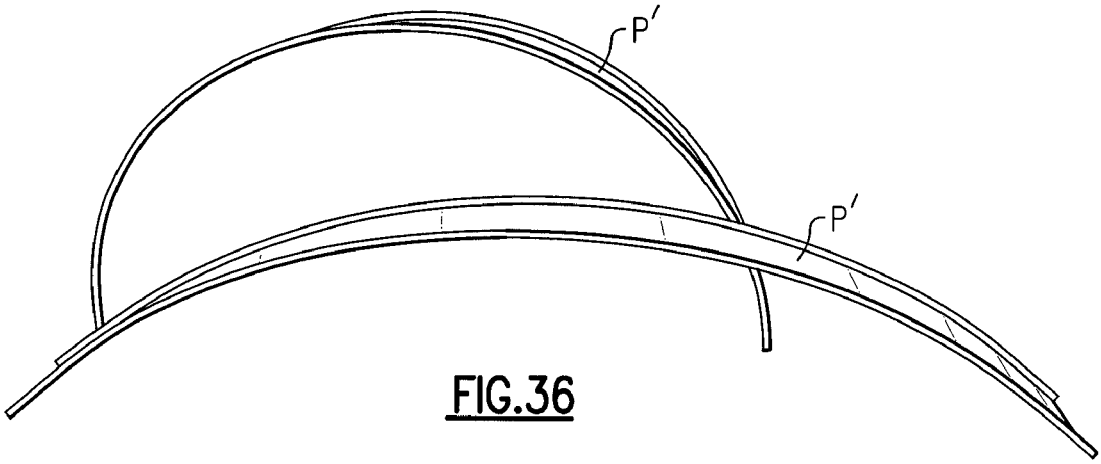
FIG.36

APPARATUS AND METHOD FOR CURVING METAL PANELS

PRIORITY CLAIM

This patent application claims the benefit of U.S. Provisional Patent Application Ser. No. 60/888,889, filed Feb. 8, 2007, the entire disclosure of which is expressly incorporated herein by reference.

BACKGROUND OF THE INVENTION

1. Field of the Invention

The present invention generally relates to material fabrication and, more particularly, relates to curving machines and methods for metal panels, such as architectural panels.

2. Description of the Related Art

Metal panels, particularly pre-formed architectural panels are well known in the art. Such metal panels are often required to be curved or radiused in different configurations for specific applications. Some prior art devices commonly used to form such curved metal panels are limited to operations on a single type of panel, and/or are not easily adjustable to provide a desired curvature on a repeatable basis. Other prior art devices may force the advancing panel to deviate from a straight path to produce the arch or curve in a panel, and this process induces internal stress in the panel, often resulting in undesirable deformities in the metal panel. Some prior art devices crimp the underside of the panel to relieve the stress built up by the curving process, but such crimping can weaken the structural integrity of the metal panel.

SUMMARY OF THE INVENTION

A panel curving apparatus for imparting a desired curvature to metal panels is disclosed. One type of metal panel, shown in FIGS. 1A and 1B, has a predetermined thickness and a substantially flat section (S), a first leg (M) extending generally perpendicular from a first edge of the flat section and a second leg (F) extending generally perpendicular from the other, second edge of the flat section, the first and second legs extending generally in the same direction, the first leg comprising a first horizontal member (UH) and a first lip member (UL), the first horizontal member extending generally perpendicular from the first edge, the first lip member (UL) extending generally perpendicular from the first horizontal member and extending generally parallel to the flat section, wherein the flat section, the first horizontal member and the first lip member form a first pocket (UP), the second leg comprising a second horizontal member (LH), a vertical member (V), and a second lip member (LL), the second horizontal member extending generally perpendicular from the second edge and generally parallel to the first horizontal member, the vertical member extending generally perpendicular from the first horizontal member and extending generally away from the first leg, the second lip member extending generally perpendicular from the vertical member and extending generally parallel to the second horizontal member and back toward the plane of the flat section, wherein the second horizontal member, the vertical member, and the second lip member form a second pocket (LP).

When used with this type of panel, the apparatus includes a rigid frame and first, second and third compression devices. The first compression device is attached to the rigid frame and has a first wheel, an opposing second wheel, and a driver motor. The driver motor is functionally connected to and drives one of the wheels. The position of at least one of the first wheel or the second wheel is adjustable with respect to the other wheel to provide a distance between the wheels which is less than the predetermined thickness of the panel. The first wheel is positioned within the first pocket and the first horizontal member is compressed between the first wheel and the second wheel. The second compression device is attached to the rigid frame and has a first wheel, an opposing second wheel, and a driver motor. The driver motor is functionally connected to and drives one of the wheels. The position of at least one of the first wheel or the second wheel is adjustable with respect to the other wheel to provide a distance between the wheels which is less than the predetermined thickness of the panel. The first wheel is positioned within the second pocket and the vertical member is compressed between the first wheel and the second wheel. The third compression device is attached to the rigid frame and has a first wheel, an opposing second wheel, and a driver motor. The driver motor is functionally connected to and drives one of the wheels. The first wheel of the second compression device is positioned between the first wheel and the second wheel of the third compression device. The position of the first wheel of the third compression device is adjustable with respect to the first wheel of the second compression device to provide a distance between the wheels which is less than the predetermined thickness of the panel and the lower horizontal member is compressed between the first wheel of the third compression device and the first wheel of the second compression device. This results in the first horizontal member being elongated by the first compression device, the vertical member being elongated by the second compression device, and the second horizontal member being elongated by the second and third compression devices, and the elongation of the first and second horizontal members and the vertical member cause the panel to curve in a predetermined direction.

In one embodiment at least one of the first compression device or the third compression device includes a bar which is pivotably mounted to the frame toward one end of the bar, one of the first wheel or the second wheel of the compression device being attached at the other end of the bar.

In another embodiment at least one of the first compression device or the third compression device includes a positioning mechanism, attached to the frame and to the bar, which sets the maximum distance between the wheels of the compression device.

In another embodiment the second compression device also includes a mechanism attached to the frame and to one of the wheels which sets the maximum distance between the wheels of the second compression device.

In another embodiment at least one of the wheels of at least one of the first compression device or the third compression device is tapered.

In another embodiment at least one of the wheels of at least one of the first compression device or the third compression device is tapered and has an outer face which generally faces away from the frame, and an inner face which generally faces toward the frame, and the outer face has a smaller diameter than the inner face.

In another embodiment there adjustable mounts attached to the frame and a curving bar attached to the adjustable mounts. The mounts can be adjusted to position the curving bar to receive and deflect the metal panel after at least portions of the first and second horizontal members and the vertical member have been elongated.

In another embodiment there are also a first feed guide which directs the panel to the first compression device and a second feed guide which directs the panel to the second and third compression devices.

The disclosed apparatus can also be used with a second type of metal panel, shown in FIGS. 2A and 2B, which has a predetermined thickness and a substantially flat section (S'), a first leg (UH') extending generally perpendicular from a first edge of the flat section and a second leg (LH') extending generally perpendicular from the other, second edge of the flat section, the first and second legs extending generally in the same direction and being generally parallel to each other. When used with this type of panel, the first wheel of the second compression device is retractable to allow the apparatus to impart a desired curvature to the second type of metal panel, the first leg is compressed and elongated by the wheels of the first compression device, the second leg is compressed and elongated by the wheels of the third compression device, and the elongation of the first and second horizontal members and the vertical member cause the panel of the second type to curve in a predetermined direction.

A method for imparting a desired curvature to a metal panel, as first described above, is also disclosed. In this method the first horizontal member is compressed and elongated, the vertical member is compressed and elongated, and the second horizontal member is compressed and elongated, which causes the panel to curve in a predetermined direction.

In another version this method also includes compressing and elongating a member by forcing the member through an opening which is less than the predetermined thickness of the panel.

In another version this method also includes compressing and elongating a member by forcing the first horizontal member between two wheels which are separated by a distance which is less than the predetermined thickness of the panel, forcing the second horizontal member between two wheels which are separated by a distance which is less than the predetermined thickness of the panel, and forcing the vertical member between two wheels which are separated by a distance which is less than the predetermined thickness of the panel.

In another version of this method forcing of the first and second horizontal members and the vertical members is done essentially simultaneously.

Another version of this method includes driving at least one of the wheels which compress the first horizontal member, driving at least one of the wheels which compress the second horizontal member, and driving at least one of the wheels which compress the vertical member, so that the first and second horizontal members and the vertical member are forced between their respective wheels.

In still another version of this method additional curvature is imparted to the panel by urging the panel against a curving bar after at least portions of the first and second horizontal members and the vertical member have been elongated. A metal panel curving apparatus and method provides a wide range of radiused curves in a metal panel without unwanted distortion, while maintaining the structural integrity and strength of the panel.

For one type of panel, three different sets of wheels, or rollers, are used to elongate or stretch three different members of the panel. This causes the elongated members to be slightly longer than other members, thereby causing the panel to naturally curve toward the non-elongated members. The use of controlled pressures on the various wheels or rollers repeatedly produces the desired elongation and, therefore, the curved panels of the desired radius. For another type of panel, only two of the three sets of wheels are used.

One benefit is that controlled and repeatable curving of metal panels is obtained.

Another benefit is that different types of panels may be curved using a single machine.

Another benefit is that distortion of a panel is reduced or eliminated.

Another benefit is that crimping is not required on the curved panel, so that the curved metal panel retains its structural integrity and strength.

Other benefits will become apparent from reading the description below and reviewing the accompanying drawings.

BRIEF DESCRIPTION OF THE DRAWINGS

FIG. 23 is a perspective view of the adjustable curving bar and top mount with scale.

FIG. 24 is a perspective view of the adjustable curving bar and bottom mount with scale.

FIG. 31 is a front perspective of Axes 1 and 2 engaged with the metal "U" panel P'.

FIG. 32 is a rear view of external curving bar and top mounts with scale set up for the metal "U" panel P'.

FIG. 35 is a perspective view, after curving, of two seamed metal panels with striations and two seamed metal panels without striations.

FIG. 36 is a view of two metal "U" panels P' having different radii of curvature.

DETAILED DESCRIPTION OF THE INVENTION

Figure 1A:
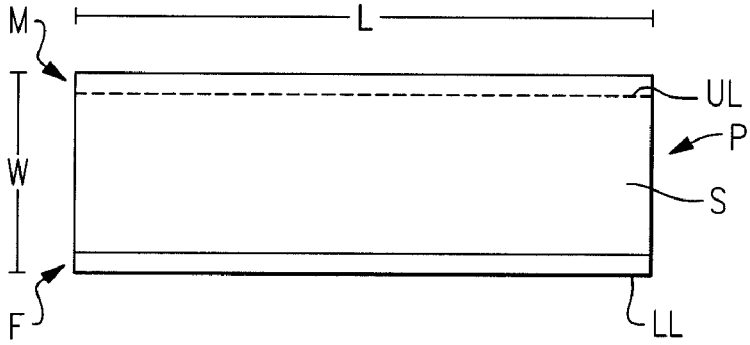
FIG.1A Prior Art
FIG. 1A illustrates a front view of one embodiment of a conventional metal panel.

Turning now to the drawings and the specification, in which like reference characters designate the same or similar parts throughout the figures, and in which preferred and exemplary embodiments of the present invention are discussed. FIGS. 3-34 illustrate or show exemplary non-limiting embodiments, and FIGS. 35 and 36 show exemplary non-limiting examples of the product provided by the present invention. A metal curving apparatus and metal curving method are provided herein for curving metal panels, such as preformed metal panels.

Figure 1B:
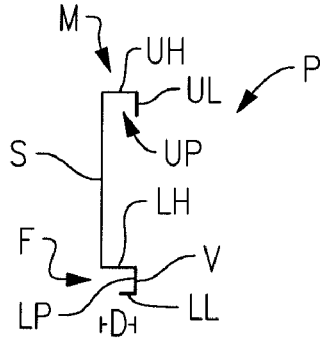
FIG.1B Prior Art
FIG. 1B illustrates a side view of one embodiment of a conventional metal panel.

FIGS. 1A and 1B illustrate front and side views, respectively, of one type of known metal panel P, commonly referred to as a mechanically seamed standing seam roof panel. Panel P comprises an upper male leg M and a lower female leg F, with a substantially flat section S therebetween, section S commonly being referred to as the pan. Upper male leg M comprises an upper horizontal member UH, commonly referred to as a male vertical leg, and an upper lip UL formed substantially at a right angle to the upper horizontal member UH, thus forming an upper pocket UP therein. Lower female leg F comprises a lower pocket LP formed from a lower horizontal member LH, commonly referred to as a female vertical leg, a vertical member V extending downward at substantially a right angle from the lower horizontal member LH and a lower lip LL extending substantially at a right angle from vertical member V, members V and LL generally collectively being referred to as a female pocket. Thus, lower lip LL extends substantially parallel to the lower horizontal member LH, the lower lip LL typically being shorter in length than the lower horizontal member LH.

One typical embodiment of this metal panel P has a depth D of approximately 2 inches, sometimes hereinafter referred to, for convenience, as either a seamed panel or a 2" panel. The depth D may be seen in the side view illustrated in FIG. 1B.

Figure 2A:
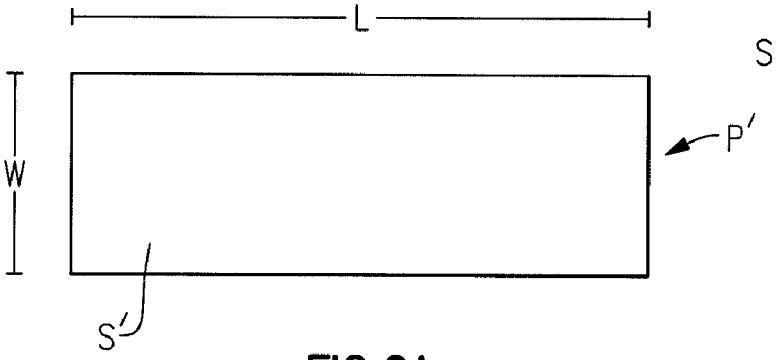
FIG.2A Prior Art
FIG. 2A illustrates a front view of another embodiment of a conventional metal panel.
Figure 2B:
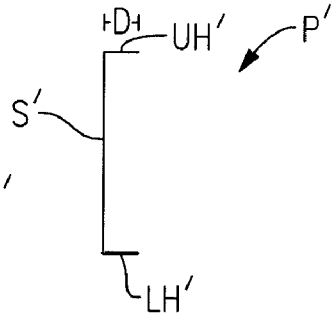
FIG.2B Prior Art
FIG. 2B illustrates a side view of another embodiment of a conventional metal panel.

FIGS. 2A and 2B illustrate front and side views, respectively, of another type of known metal panel P, commonly referred to as a "U" panel or snap-batten, which also comprises an upper male leg M and a lower female leg F, with a substantially flat section S therebetween. Panel P', however, does not have pockets, such as pockets UP and LP of FIG. 1B, but does have a substantially flat section S' and upper and lower horizontal members UH' and LH'. Members UH' and LH' are commonly referred to simply as vertical legs.

One typical embodiment of this metal panel P' has a depth D of approximately 1 inch, hereinafter referred to, for convenience, as either a "U" panel or a 1" metal panel. The depth D may be seen in the side view illustrated in FIG. 2B.

The panels P, P' may have a length L that may be virtually any length. For example, panels as long as 140 feet have been successfully curved using the present invention. Shorter length panels have also been successfully curved. One example of a relatively standard shorter length is 10 feet. Even shorter metal panels, having a length as short as 3 feet or even less, may be successfully curved. The minimum length is primarily dependent upon the curvature desired and upon whether the external curving bar 82 (discussed below) is necessary to obtain the desired curvature.

The industry standard width W of a panel is typically in the range of about 8" to 18" wide and, still more typically, 12" to 16" wide. This is a standard but is not, however, a design limitation. Other desired widths W, larger or smaller, may also be used. Aside from other considerations, such as cost, transportation, ease of installation, durability, reliability, etc., the maximum usable width of a panel is determined primarily by whether the rolling (compression and elongation) of the upper and lower horizontal members (UH, UL) provides sufficient force or torque to properly curve the panel. Also, aside from other considerations, such as cost, transportation, ease of installation, durability, reliability, etc., the minimum width of a panel which can be curved using the present invention is determined primarily by the size of the particular wheels used.

Also, although panel depths of 1" and 2" are mentioned herein, the present invention is not limited to those panel depths. Panels with a depth of one-and-a-half inches have also been curved, and use of panels with a depth of 3 inches, or even greater, appears to be possible but has not yet been tested.

The terms "upper" and "lower", as applied to male leg M and female leg F, are for convenience and refer to the orientation of the metal panels P, P' when positioned within the exemplary disclosed curving apparatus, i.e., a panel P, P' is oriented substantially vertically. Vertical orientation is a preference for convenience of operation, such as for ease in insertion of raw panels and in removal of curved panels, but is not a requirement. As is seen in FIGS. 1A, 1B, 2A and 2B, the upper horizontal member UH, UH' and the lower horizontal member LH, LH' project from the section S, S' at substantially right angles.

Also, metal panels P, P' with or without striations may be used, as desired. Striations across section S, if used, reduce a phenomenon commonly known as "oil-canning", which results from, for example, internal stresses induced due to roll forming operation, installation issues and other known mechanisms.

The metal panels are preferably, but not necessarily, a standard gauge metal, such as 24 gauge metal. Other gauges may be used, for example, 22 and 26 gauge, as desired or as necessary for a particular installation. The particular gauge metal used is therefore generally not determined by, or a limitation of, the curving apparatus.

Figure 3:
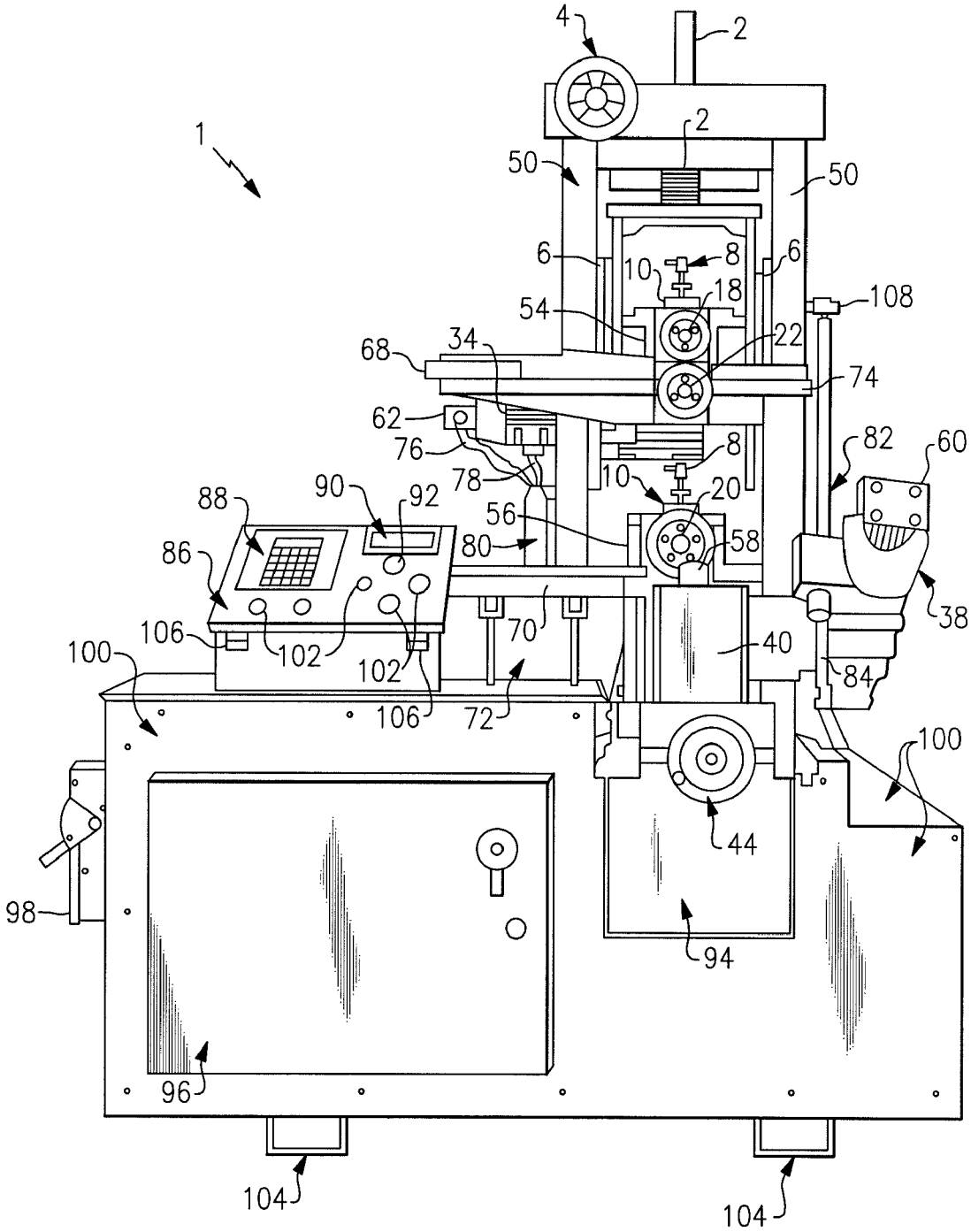
FIG. 3 is a front view or operator's-side view of one exemplary embodiment of a curving apparatus according to the present invention.
Figure 4:
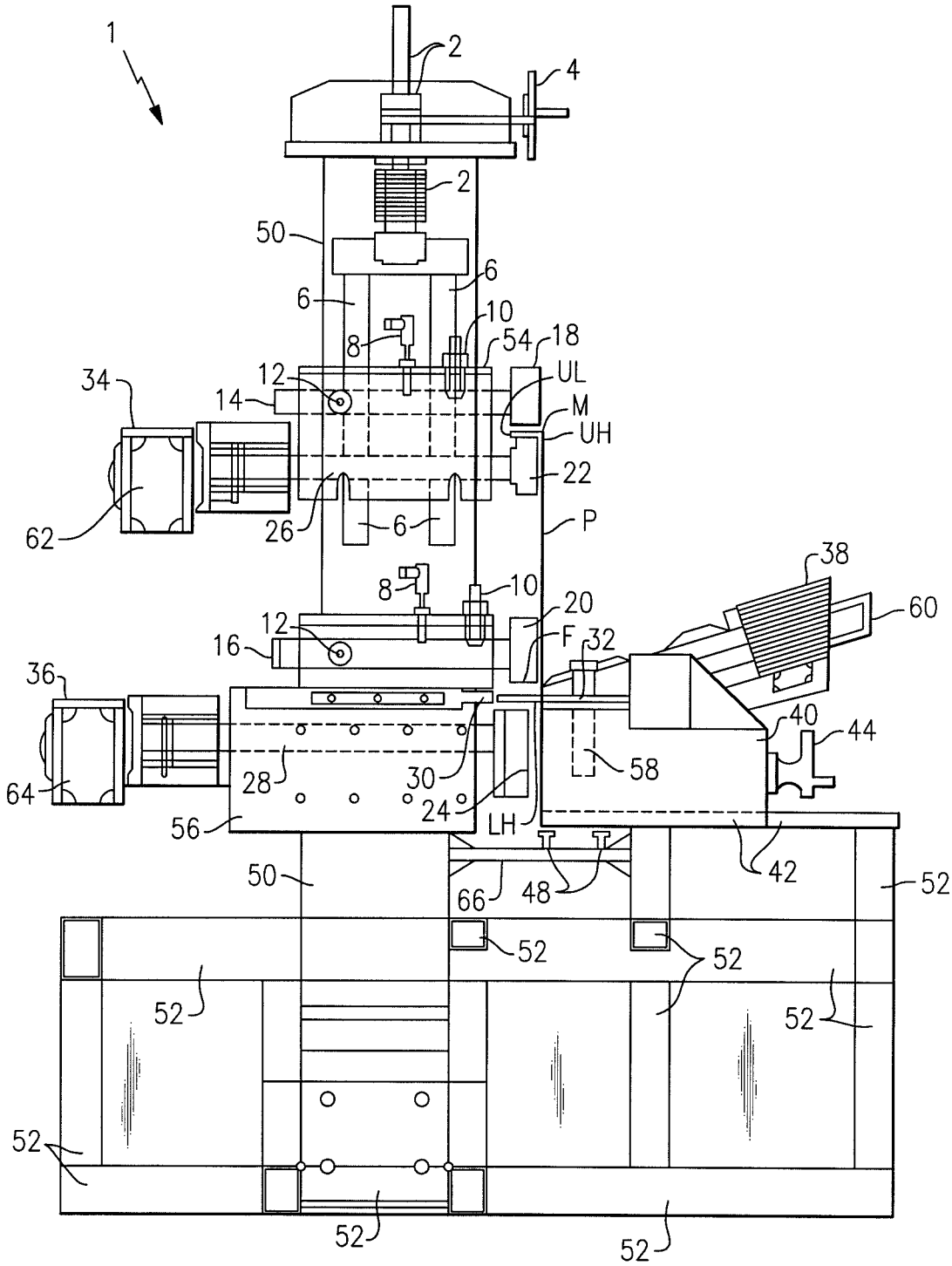
FIG. 4 is a side view or section view left of the curving apparatus of FIG. 3.

FIGS. 3 and 4 illustrate one exemplary embodiment of the metal curving apparatus 1 capable of curving metal panels, with FIG. 3 providing a front view and FIG. 4 a left side view. The curving apparatus 1 comprises a tubular steel support frame 52 forming a stable base for the curving apparatus 1, with vertical tubular steel upright frame 50 fixedly attached to tubular steel support frame 52. This arrangement provides a solid structure for mounting of the curving apparatus 1 elements and for achieving repeatable metal panel P, P', curvatures with minimal radius deviations. The frames 50, 52 should be sufficiently rigid and sufficiently attached to each other, and to the other elements, to prevent twisting, spreading or other dimensional instability of the apparatus. Dimensional instability may result in improper curvatures, varying curvatures on a single panel, twisting or warping of a panel, or non-repeatable results.

FIG. 3 illustrates sheet metal cover panels 100 substantially covering the tubular steel support frame and components held therein. FIG. 4 provides a side view of the tubular steel support frame 52, with sheet metal cover panels 100 removed. Curving apparatus 1 may also comprise forklift pockets 104 for convenience in moving the apparatus.

The curving apparatus 1 comprises three possible pressure points, referred to as Axis 1, Axis 2, and Axis 3. Axes 1 and 2 exert a known amount of substantially vertical pressure on an upper male leg M and a lower female leg F, respectively, of the metal panel P (or P'). Axis 3 works in concert with Axis 2 to exert substantially horizontal and vertical pressure on the lower female leg F of the metal panel P, particularly components LH and V. Axis 3 is not required, and therefore is generally not used, to curve the "U" metal panel P'.

Figure 5:
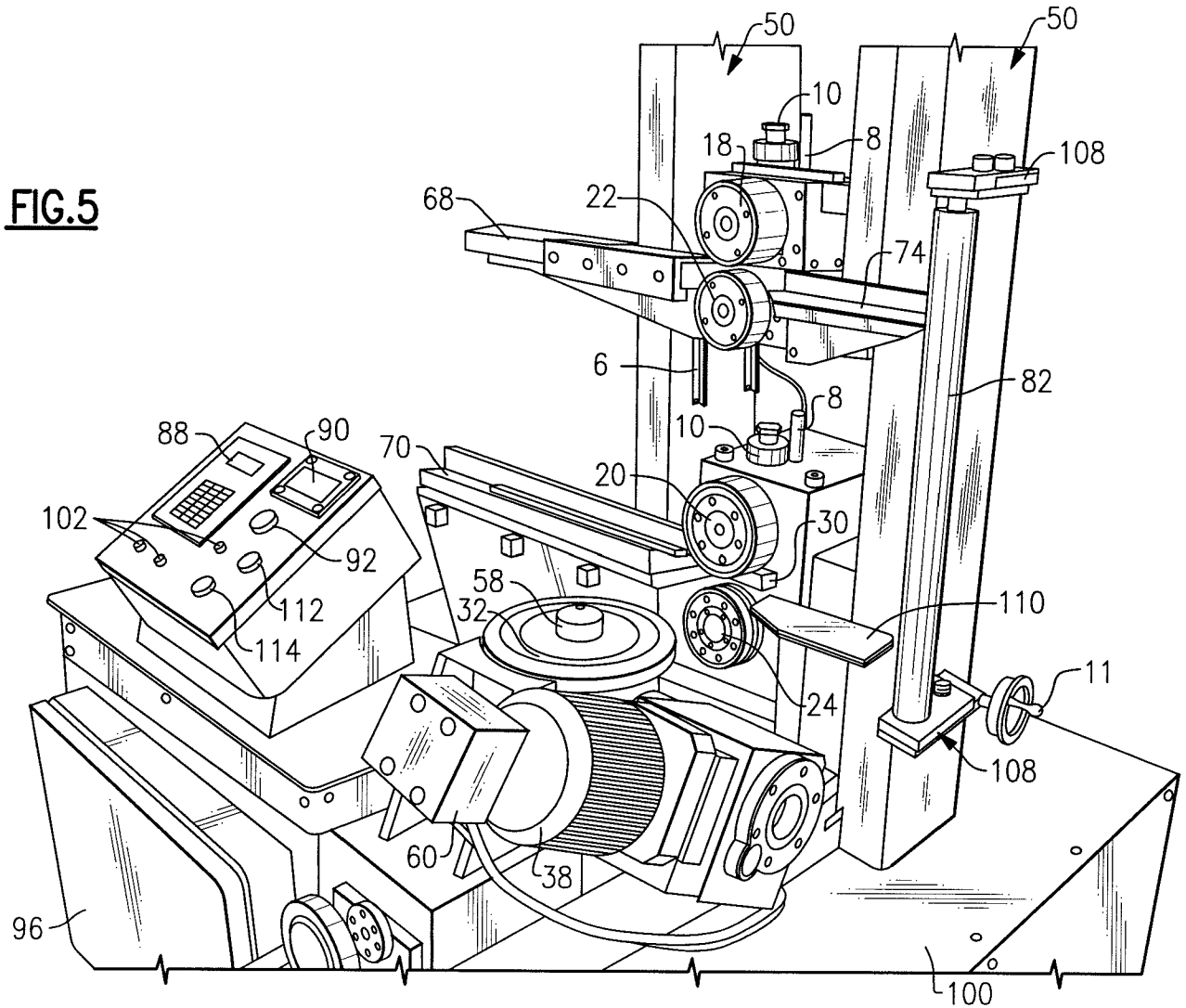
FIG. 5 is a perspective view of one exemplary embodiment of a curving apparatus.

As shown in FIGS. 3-5, axis 1 comprises pressure wheel 18 and drive wheel 22. Pressure wheel 18 is attached to proximal end of pressure bar (or rod, or axle) 14. Pressure wheel 18 is freely rotatable on, and is attached to, pressure bar 14 by methods well known to those skilled in the art.

Pressure bar 14 is non-rotatably disposed within axis 1 casing 54 which is mounted to vertical tube steel upright frame 50. Pressure bar 14 further comprises a pressure bar pivot point 12 wherein pressure bar 14 is capable of substantially vertical movement within axis 1 casing 54. "Substantially" vertical is used because pressure bar 14 has a pivot point and therefore actually rotates about the pivot point. Within the typical range of movement, however, the movement of the pressure bar 14 is approximately vertical at the end where wheel 18 is attached.

A screw tightened pressure applicator 10 is provided to allow manual raising or lowering of pressure bar 14 which, in turn, raises or lowers pressure wheel 18. Thus, tightening the screw within pressure applicator 10 results in lowering of pressure bar 14, thereby increasing the pressure exerted on the panel member UH which is between wheels 18 and 22, while loosing the screw within pressure applicator 10 results in raising pressure bar 14, thereby decreasing the pressure exerted on the panel member. Sensor 8 monitors the distance traveled by the pressure bar 14, or the position of the pressure bar 14 with respect to a predetermined reference position, which, in turn, equates with the amount of pressure applied by pressure bar 14 and its pressure wheel 18. Sensor 8 is of a type well known to those skilled in the art, e.g., a linear variable differential transformer (LVDT) sensor may be used.

In one embodiment, pressure wheel 18 has the same diameter across its length. In another embodiment, wheel 18 is tapered, with the outer face of wheel 18 having a slightly smaller diameter than the inner face. This assures that greater pressure, and therefore greater elongation, occurs toward the outer edge of member UH. In one embodiment, the inner (rear) face of wheel 18 has a diameter of 3.9995 inches and the outer (front) face has a diameter of 3.9595 inches.

The axis 1 drive wheel 22 is rotatably attached to drive shaft 26, the drive shaft 26 being disposed within axis 1 casing 54. Axis 1 drive shaft 26 is driven by axis 1 electrical drive motor 34. Drive motor power cord 78 (FIG. 3) provides electrical power to the axis 1 drive motor 34. Thus, operation of the drive motor 34 causes the drive shaft 26 and drive wheel 22 to rotate, which then pulls the panel between and through the wheels 18 and 22.

Figure 7:
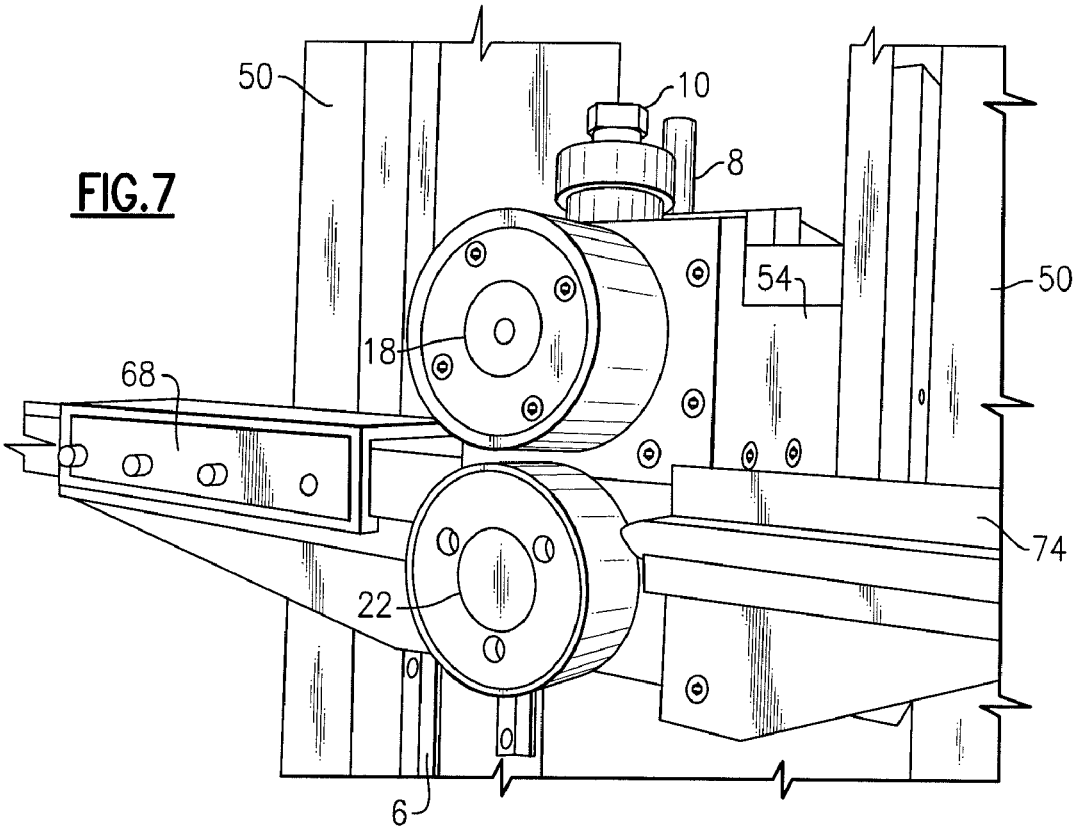
FIG. 7 is a perspective view of Axis 1.

The pressure wheel 18 and drive wheel 22 comprise outer surfaces that are preferably substantially vertically aligned in order to accommodate the upper horizontal member UH of the male edge M of metal panel P therebetween. (FIGS. 3, 5 and 7.) These surfaces need not be exactly vertically aligned as it is only necessary that the alignment be adequate to provide the appropriate compression of the member. When a metal panel P (or P') is guided onto the curving apparatus 1, the upper horizontal member UH is received between the pressure wheel 18 and the drive wheel 22. Then, the pressure wheel 18 may be lowered using screw tightened pressure applicator 10 to provide the desired pressure on the received metal panel P. Moreover, drive wheel 22 is partially received into the upper pocket UP of the metal panel P (FIG. 11), wherein the upper horizontal member UH may rest against the drive wheel 22 outer surface. The engagement of the metal "U" panel P' will be discussed further below.

The elements of axis 1 may be vertically adjusted to accommodate various widths of metal panel and to eliminate any pillowing in the metal panel once pressure has been applied to all three axes. As illustrated in FIGS. 3 and 4, a keyed traveling jack 2, actuated by hand wheel 4, may be used to raise and lower axis 1 in its entirety. Keyed traveling jack 2 is mounted to and supported by vertical tube steel upright frame structure 50. At least two vertical ball bearing slides 6 are mounted to the traveling jack 2. Axis 1 casing 54 is fixedly mounted to the slides 6 and as a result, axis 1, including, among other components, pressure wheel 18 and drive wheel 22, may be adjusted vertically, i.e., either raised or lowered. See FIGS. 5, 7, 11, 12, 27, 28 and 31 for additional illustration of axis 1 and the elements and operation thereof described herein.

Axis 2 comprises pressure wheel 20 and drive wheel 24. Pressure wheel 20 is attached to proximal end of pressure bar 16. Pressure wheel 20 is freely rotatable on, and is attached to, pressure bar 16 by methods well known to those skilled in the art. Pressure bar 16 is non-rotatably disposed within axis 2 casing 56 which is fixedly mounted to vertical tube steel upright frame 50. As discussed above in connection with axis 1, the axis 2 pressure bar 16 also comprises a pressure bar pivot point 12 wherein pressure bar 16 is capable of substantially vertical movement within axis 2 casing 56. "Substantially vertical" movement is used to describe the movement of pressure bar 16 for the same reasons as for bar 14. Moreover, similar to axis 1, a screw tightened pressure applicator 10 is provided to allow manual raising or lowering of pressure bar 16 which, in turn, raises or lowers pressure wheel 20. Thus, tightening the screw within pressure applicator 10 results in lowering of pressure bar 16, thereby increasing the pressure exerted on the panel member LH which is between wheels 20 and 24, while loosing the screw within pressure applicator 10 results in raising pressure bar 16, thereby decreasing the pressure exerted on the panel member. Another sensor 8 monitors the distance traveled by, or the position of, the pressure bar 16 which, in turn, equates with the amount of pressure applied by pressure bar 16 and its pressure wheel 20.

In one embodiment, pressure wheel 20 has the same diameter across its length. In another embodiment, wheel 20 is tapered, with the outer face of wheel 20 having a slightly smaller diameter than the inner face. This assures that greater pressure, and therefore greater elongation, occurs toward the outer edge of member LH. In one embodiment, the inner (rear) face of wheel 20 has a diameter of 5.1075 inches and the outer (front) face has a diameter of 4.8930 inches.

Figure 6:
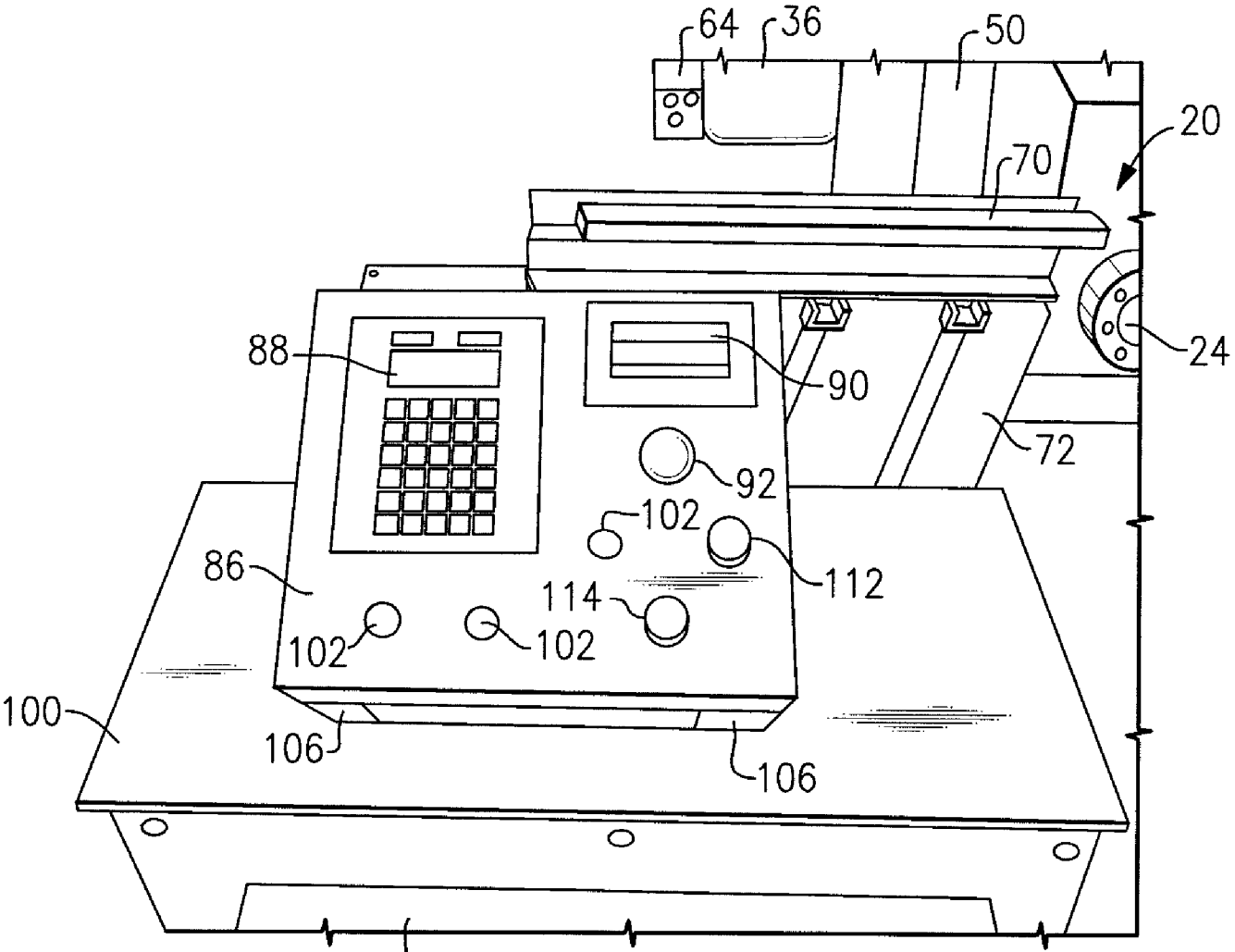
FIG. 6 is a front view of the human interface control panel 86.

LVDT sensors 8 are functionally connected to, and provide data to, the interface control panel 86, so that the LVDT data may be displayed on the LVDT sensor read-out panel 90 of control panel 86. (FIGS. 3 and 6.)

The axis 2 drive wheel 24 is rotatably attached to drive shaft 28, the drive shaft 28 being disposed within axis 2 casing 56. Axis 2 drive shaft 28 is driven by axis 2 electrical drive motor 36, with power supplied by a power cord (not shown). Thus, operation of the drive motor 36 causes the drive shaft 28 and drive wheel 24 to rotate, which then pulls the panel between and through the wheels 20 and 24.

Figure 8:
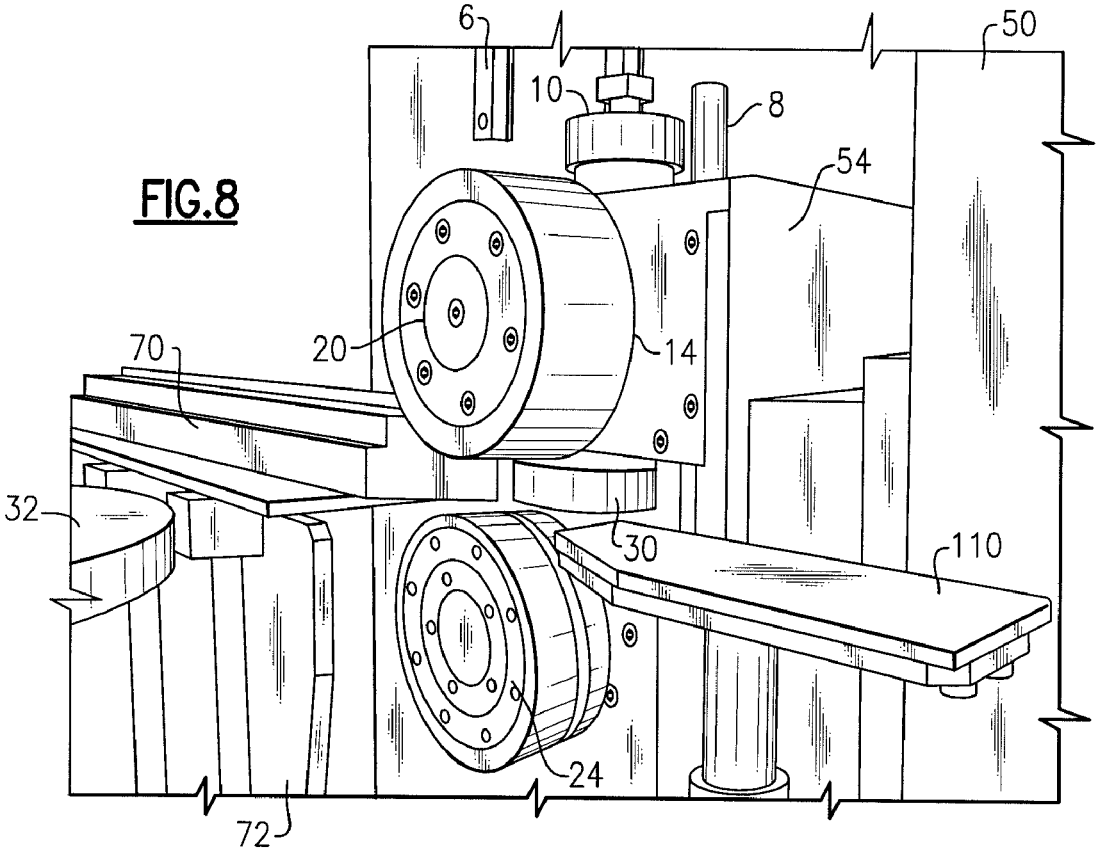
FIG. 8 is a perspective view of Axis 2.

The pressure wheel 20 and drive wheel 24 comprise outer surfaces that are preferably substantially vertically aligned in order to accommodate the lower horizontal member LH of the female edge F of metal panel P therebetween. (FIGS. 3 and 8.) The wheels 20 and 24 apply pressure to the female edge F of the metal panel P that will be held between them. (FIGS. 3 and 8.) When metal panel P is guided onto the curving apparatus 1, the lower horizontal member LH is received between the wheels 20 and 24, the vertical member V is received adjacent the wheel 30, and the lower lip LL is received adjacent the drive wheel 24. Note that, at this point, wheel 32 is not yet engaged. Then, the wheel 32 is brought into engagement so that member V is between wheels 30 and 32, and wheel 32 is also between wheels 20 and 24.

The pressure wheel 20 may then be lowered, using screw tightened pressure applicator 10 as discussed above, to provide the desired pressure on the received metal panel P with respect to wheels 20 and 32. When the pressure wheel 20 is lowered to provide the required amount of pressure, wheels 20 and 32 engage the lower horizontal member LH, wheels 30 and 32 engage the vertical member V, and the lower lip LL is between wheels 32 and 24.

Figure 13:
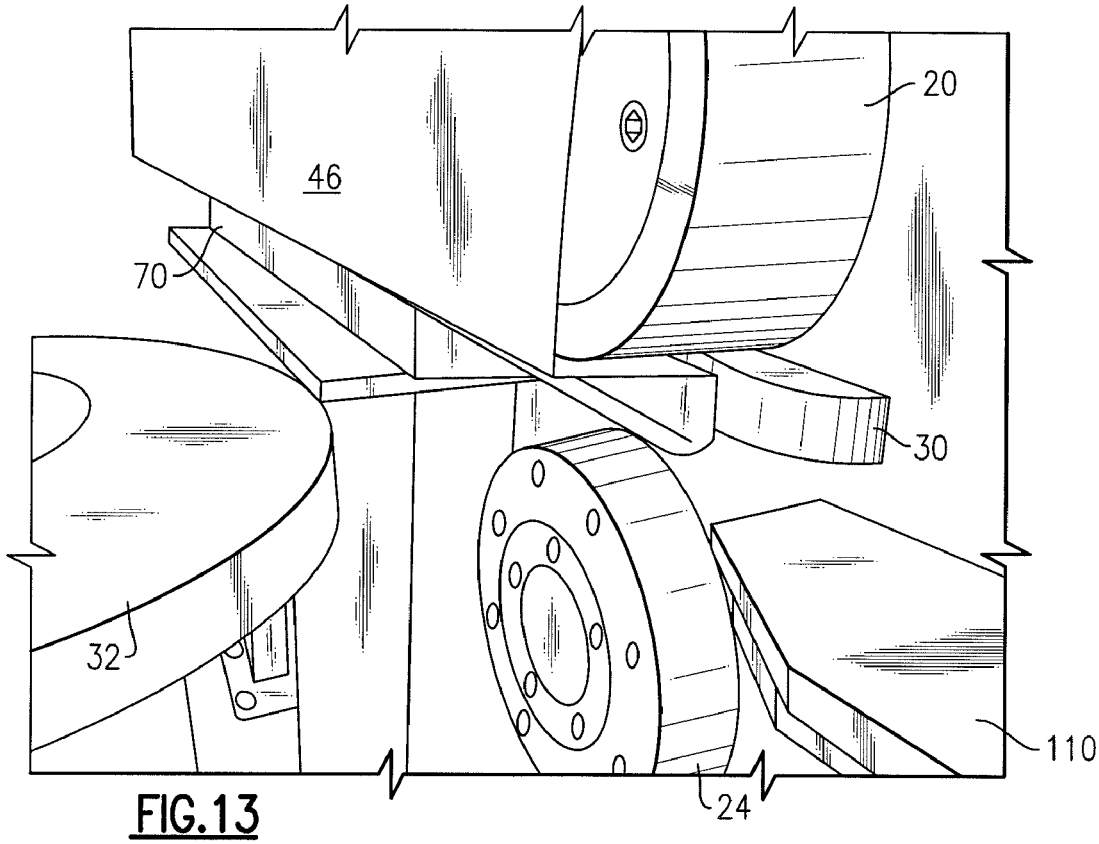
FIG. 13 is a front perspective view of Axes 2 and 3 with the female leg of the seamed metal panel P disengaged.

It is generally neither desirable nor necessary to act on lower lip LL so, in one embodiment, drive wheel 24 has two sections. A first section, having a first diameter, which bears against the wheel 32, and a second section, having a second, smaller diameter. In one embodiment, the first (front) diameter is 4.5220 inches and the second (rear) diameter is 4.4220 inches. Preferably, there is also a slight notch at the junction of the front and rear sections, the notch having a depth of 0.2765 inch with respect to the front diameter, and having a width of 0.2555 inches. The two sections of wheel 24 are best seen in FIGS. 8 and 13. As the wheel 32 will bear on the larger diameter, first section, there will be a space between the wheel 32 and the smaller diameter, second section of wheel 24, and the lower lip LL is in this space. (See FIGS. 8, 13 and 14.) This prevents compression and distortion of the lower lip LL. In addition, the notch allows additional space for LL to prevent LL from being compressed between wheels 24 and 32. Wheel 24 may therefore be considered to have a recessed area and a notched area to prevent damage to or distortion of lower lip LL. If desired, wheels 24 and 32 may apply minor pressure on LL to keep lower lip LL from distorting but, in contrast to the pressures applied on members UH and V, wheels 24 and 32 preferably do not apply any significant pressure to lower lip LL.

Axis 2 is preferably fixed vertically and is generally not vertically adjustable. This is a preference, but not a limitation, so, if desired, however, axis 2 could be made vertically adjustable, and could be raised or lowered in the same manner as for axis 1 by using a traveling jack and a hand wheel.

See FIGS. 5, 8, 10, 13, 14, 22, 29, 30 and 31 for additional illustration of axis 2 and the elements and operation thereof described herein.

Figure 14:
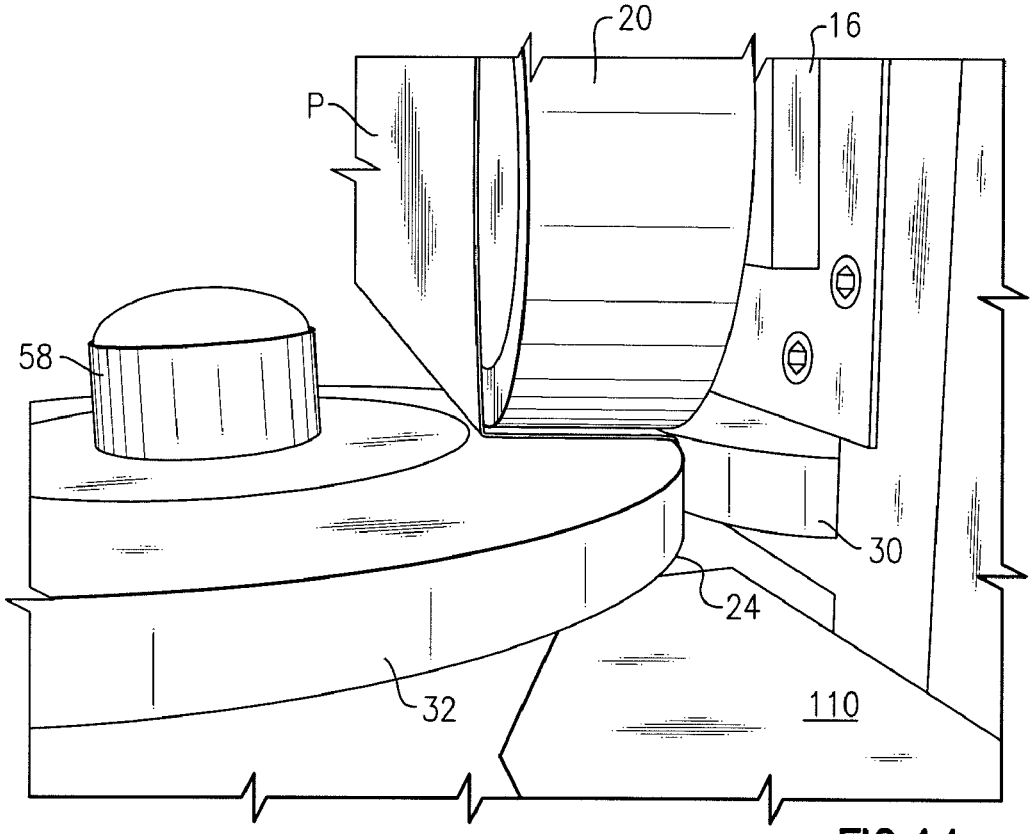
FIG. 14 is a front perspective view of Axes 2 and 3 with the female leg of the seamed metal panel P engaged.
Figure 15:
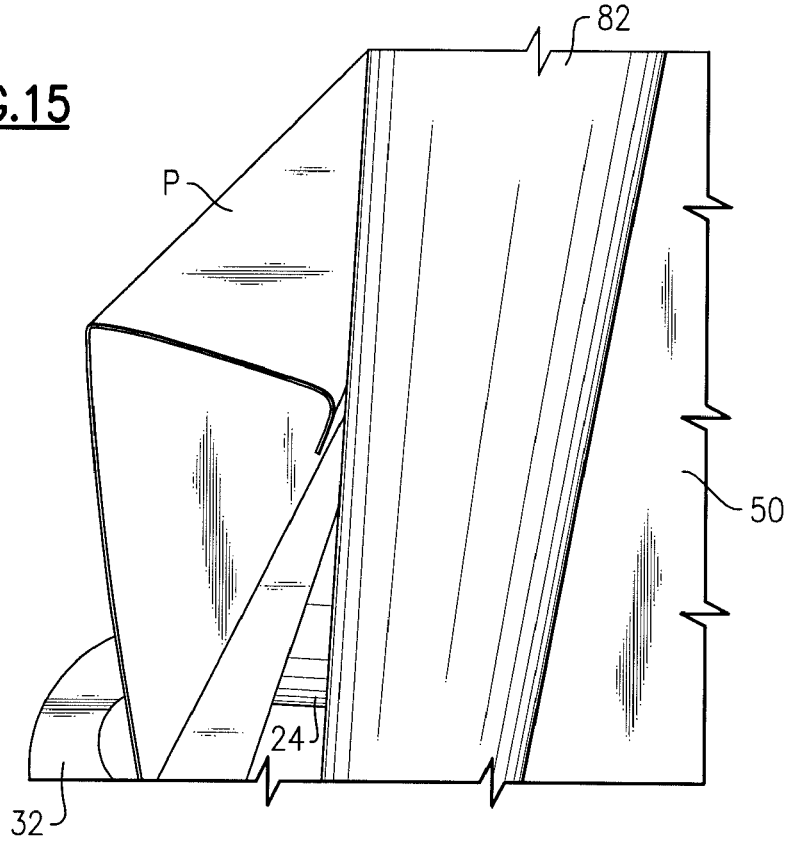
FIG. 15 is a side view of external curving bar with the male leg of the seamed metal panel P.
Figure 16:
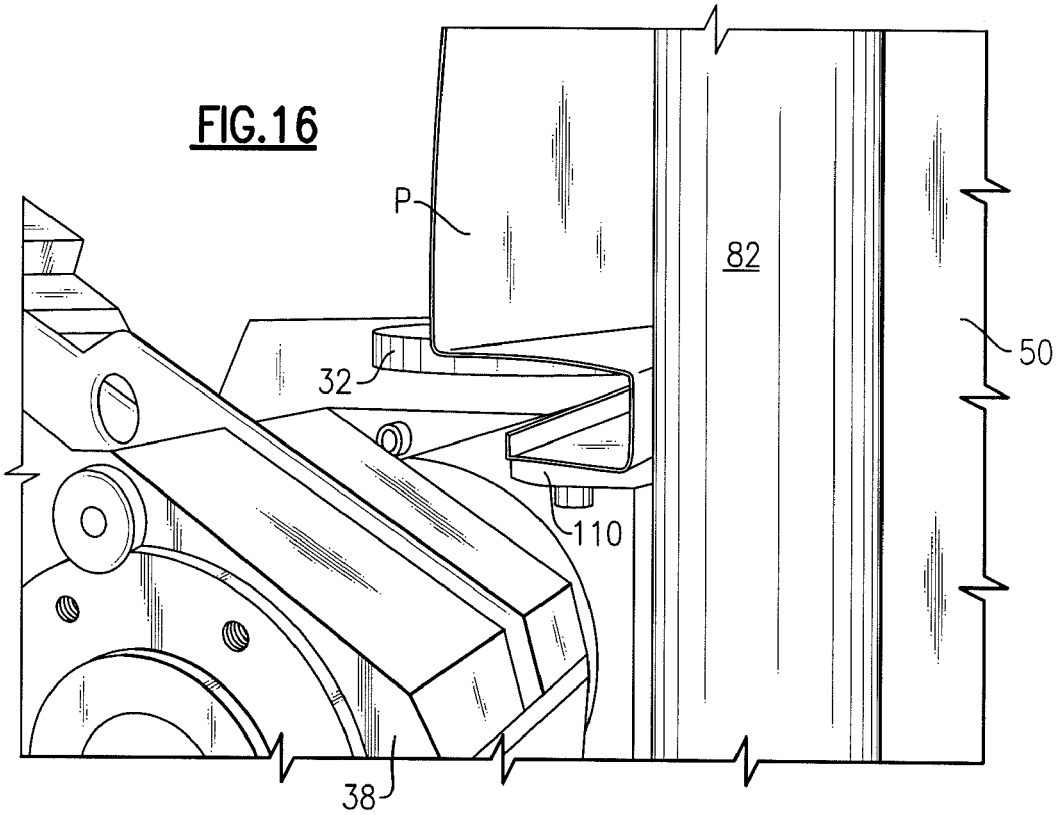
FIG. 16 is a side view of external curving bar with the female leg of the seamed metal panel P.

Axis 3, unlike both Axes 1 and 2, provides pressure on the metal panel P in a substantially horizontal manner and, more particularly, to vertical member V. (See FIGS. 4, 5, 8-10 and 13.) Axis 3 comprises freely rotatable anvil wheel 30 and drive/pressure wheel 32. Drive/pressure wheel 32 places pressure upon the member V between wheel 32 and freely rotatable anvil wheel 30. Axis 3 may be considered to be fixed both vertically and horizontally as anvil wheel 30 is fixed both horizontally and vertically. Drive/pressure wheel 32 moves horizontally, but is preferably fixed vertically. Drive/pressure wheel 32 is moved horizontally into engagement with panel P by use of hand wheel 44 using keyed slots 42 as a guide, a mechanism well known to those skilled in the art. (See FIGS. 9 and 10.) Keyed slots 42 are well known in the art; one particular example is the SECO SLIDE™ product, commercially available from SECO. Specifically, drive/pressure wheel 32 is moved into engagement with lower pocket LP, pressuring lower pocket LP, specifically vertical member V, against anvil wheel 30 at a predetermined pressure. (FIGS. 14 and 16.) Drive/pressure wheel 32 is driven by the axis 3 electrical motor 38 with power cord 84 via axis 3 drive shaft 58. Operation of motor 38 causes rotation of drive shaft 58 which, in turn, urges driving rotation of drive/pressure wheel 32. Thus, preferably, all three axes are driven. This prevents slippage of one part of the panel with respect to another part of the panel, as slippage could result in distortion of, or damage to, the panel.

Figure 9:
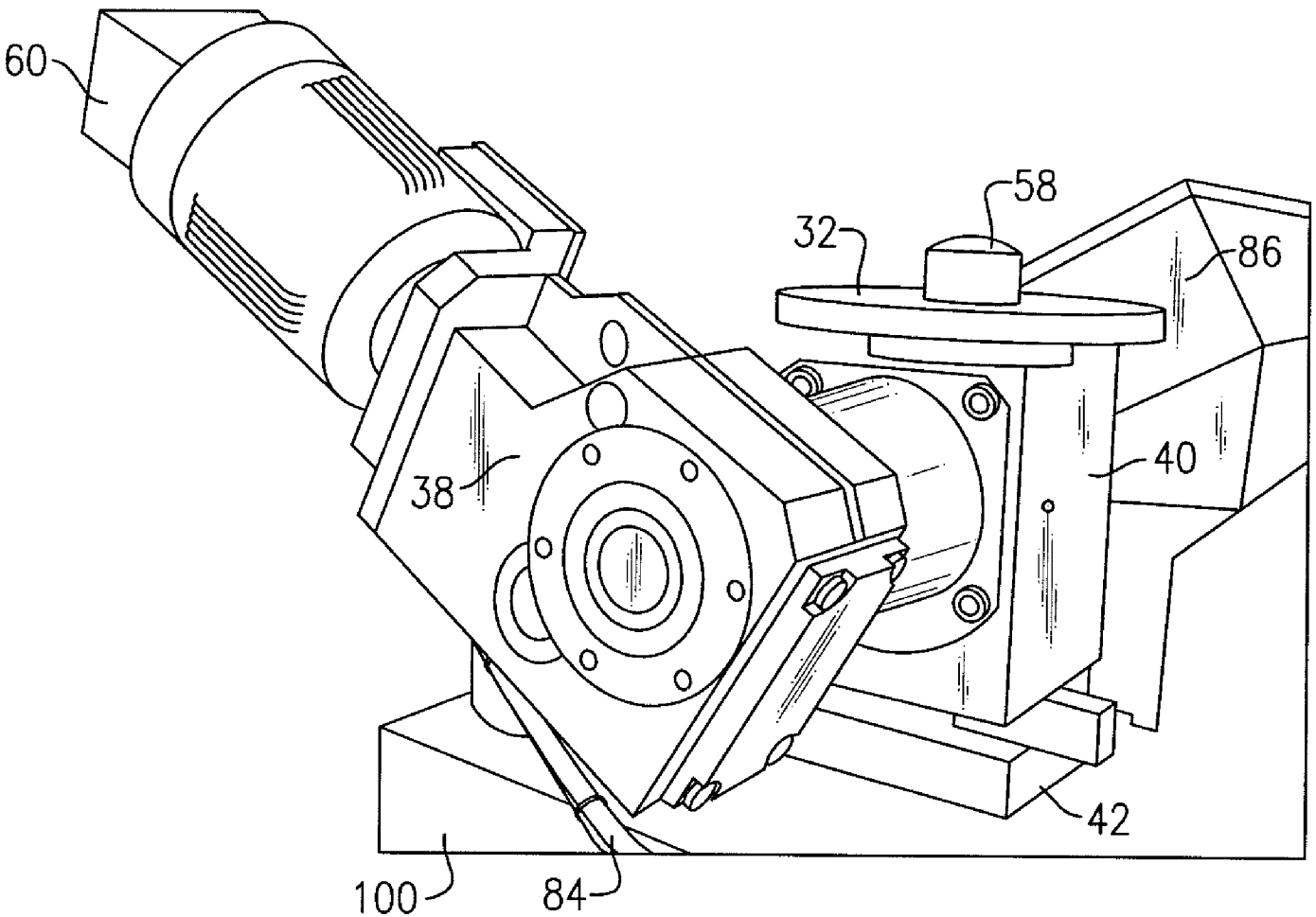
FIG. 9 is a right side view of a portion of Axis 3.
Figure 10:
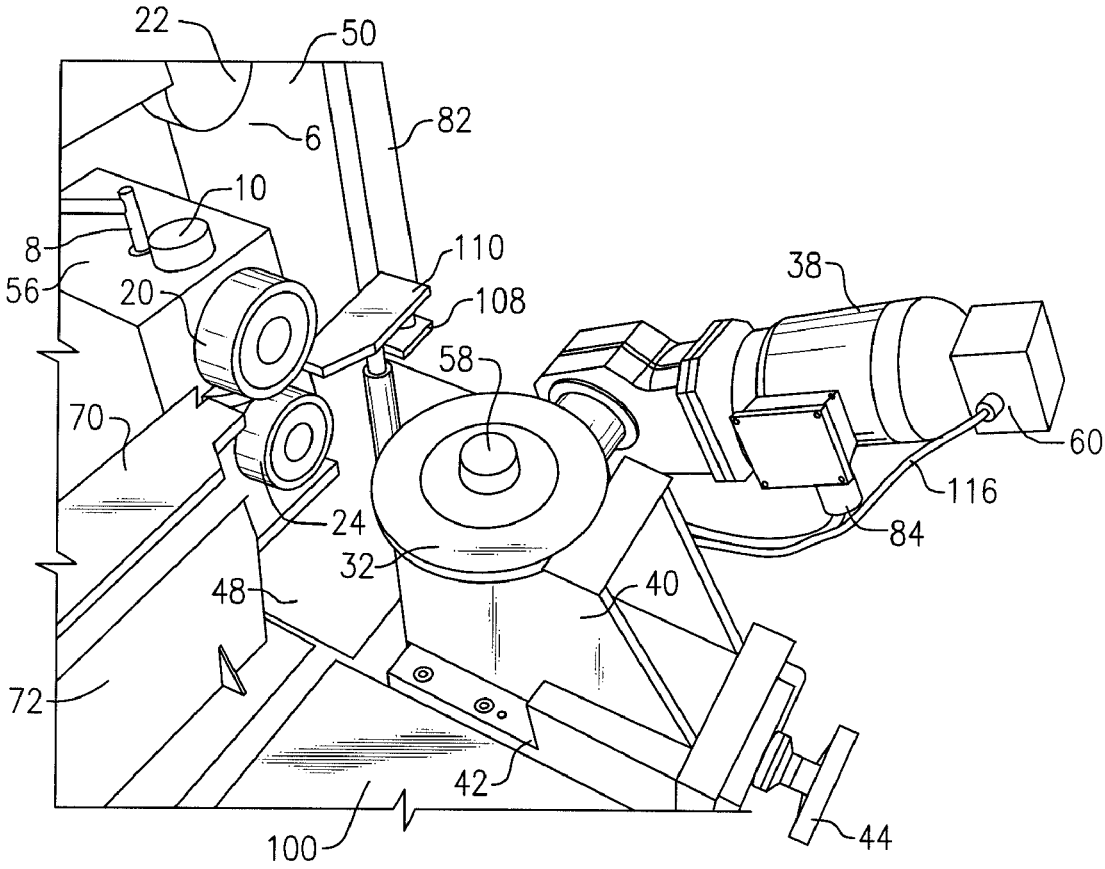
FIG. 10 is a top view of Axes 2 and 3.
Figure 11:
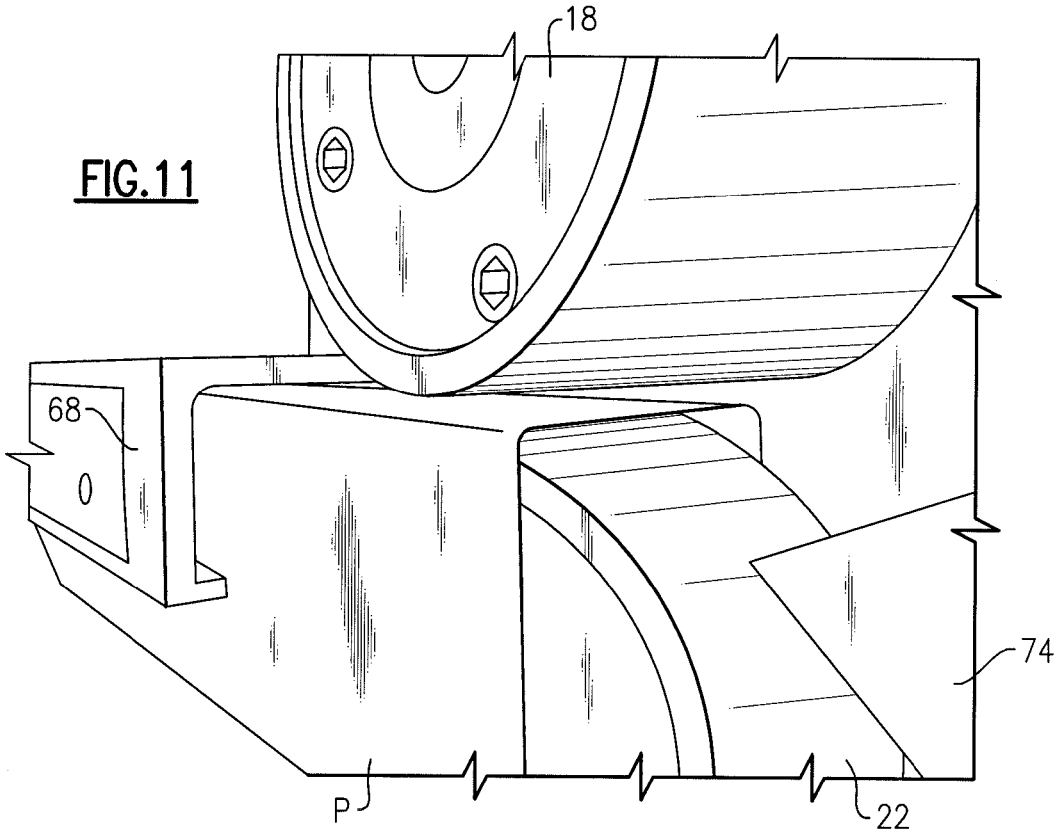
FIG. 11 is a front perspective view of Axis 1 with the male leg of the seamed metal panel P disengaged.
Figure 12:
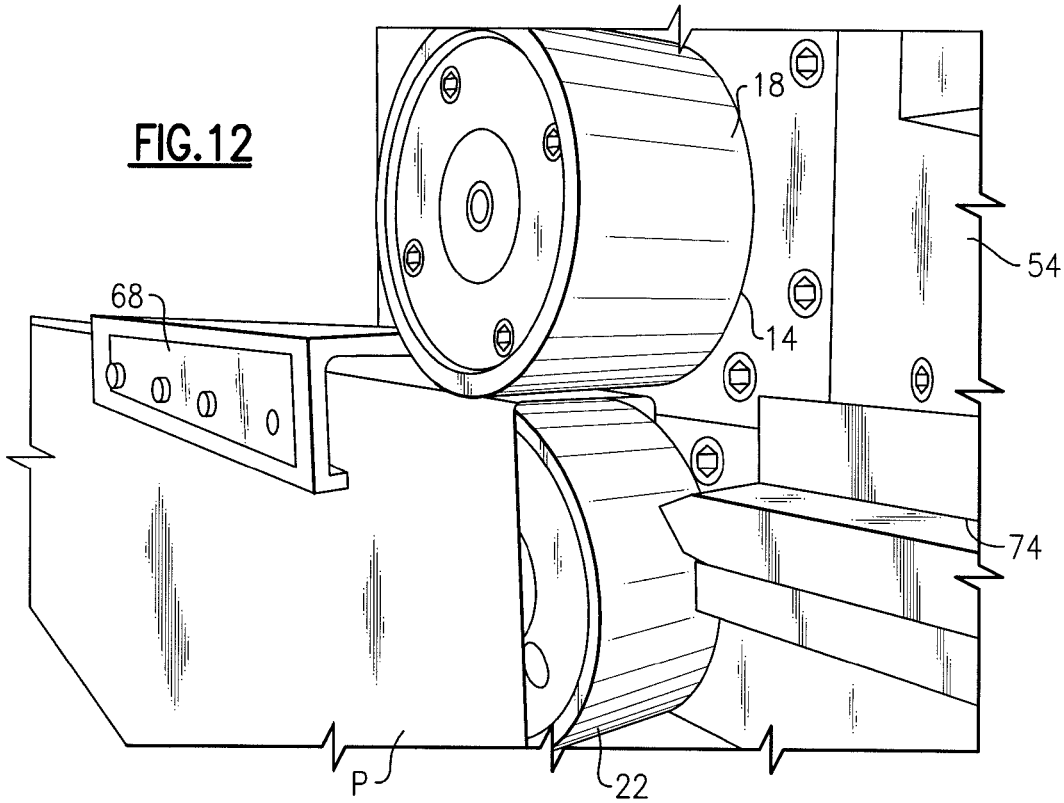
FIG. 12 is a front perspective view of Axis 1 with the male leg of the seamed metal panel P engaged.

Axis 3 is supported by the tube steel support frame 52 and the vertical tube steel upright frame 50. A welded support plate 66 is attached to both the support frame 52 and the upright frame 50, with welded jack bolts 48 (FIG. 4) attached thereto engaging the lower surface of the axis 3 gear box 40 (FIGS. 9 and 10).

See FIGS. 5, 9, 10, 13 and 14 for additional illustration of axis 3 and the elements and operation thereof described herein.

Thus, curving along the axis 1 is provided by wheels 18 and 22, curving along the axis 2 is provided by wheels 20 and 24 for the "U" panel or wheels 20 and 32 for the seamed panel, and curving along the axis 3 for the seamed panel is provided by wheels 30 and 32.

External curving bar 82 is provided downstream of axes 1, 2 and 3. (See FIGS. 3, 10, 15, 16, 23, 24 and 31-34.) The external curving bar 82 is freely rotatable and is mounted to the curving apparatus 1, specifically to a vertical tube steel upright frame 50, using external mounts 108. As may be best seen in FIGS. 23 and 24, the external mounts 108 are slotted and their position is adjustable. Preferably, to aid in the positioning, a numbered scale is provided on the external mounts 108. As the metal panel exits from the pressure of axes 1, 2 and/or 3, it will have at least a natural curvature from the compression and spreading of the members due to the pressures applied by the various wheels or rollers of the axes 1, 2 and/or 3. If this natural curvature is satisfactory then the curving bar 82 is not needed. If, however, more curvature is desired, the panel may then engage curving bar 82, which decreases the radius of the curvature. As the metal panel exits from axes 1, 2 and/or 3 it will bear against curving bar 82, when then forces the panel into a tighter curvature. The additional curvature available is determined primarily by the offset of the curving bar 82, the distance between the axes 1, 2 and/or 3 and the curving bar, the length of the panel, and the gauge and material of the panel, which affect the ability and tendency of the panel to curve, rather than buckle, when bearing against the curving bar 82.

The curved metal panels produced by the present invention are controlled and repeatable. The predetermined pressures applied at axes 1, 2 and/or 3 and the position of the external curving bar 82, if used, control the curvature of the finished product.

Curving apparatus 1 is powered by power cord 99 which extends from primary electrical power box 98 (FIGS. 3 and 19) and may be plugged into a compatible electrical outlet or generator. Power is switched on via the electrical power box 98, allowing electrical power to reach components in the frequency inverter power box 96 (FIGS. 3, 5, 17 and 19.) after first passing through power supply cabinet 144 (FIG. 19).

Figure 17:
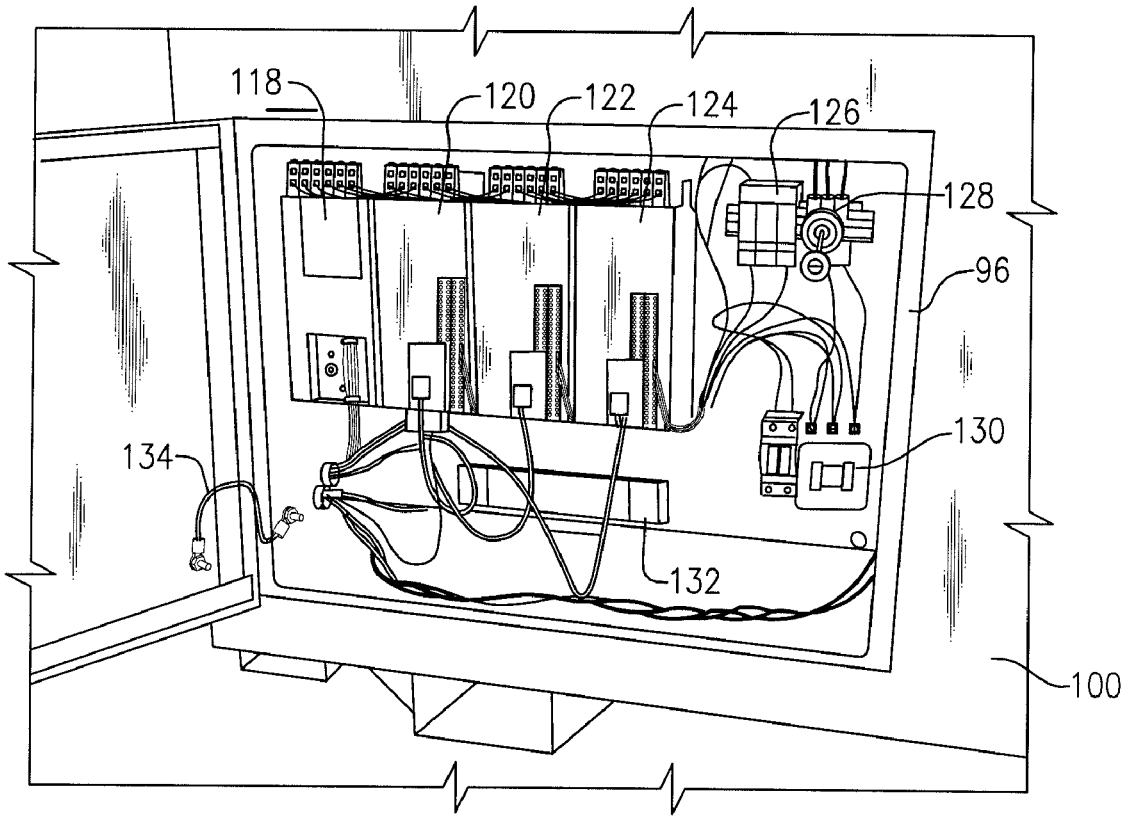
FIG. 17 is a view of the opened frequency inverter power control box.

Frequency inverter motor speed control box 96 is illustrated with door closed in FIG. 3 and door open in FIG. 17. With specific reference to FIG. 17, the master frequency inverter 118, and slave frequency inverter 120 for axis-1, slave frequency inverter 122 for axis-2, and slave frequency inverter 124 for axis-3, are functionally connected to, and are in communication with, the control panel 86, i.e., preferably at least with the motor speed/rpm control pad 88. (FIGS. 6, 17.) Buss fuses 126 and an on/off switch 128 are shown. Motor contractor K1 is illustrated at 130 along with relay switch 132 and cabinet door ground 134.

Figure 18:
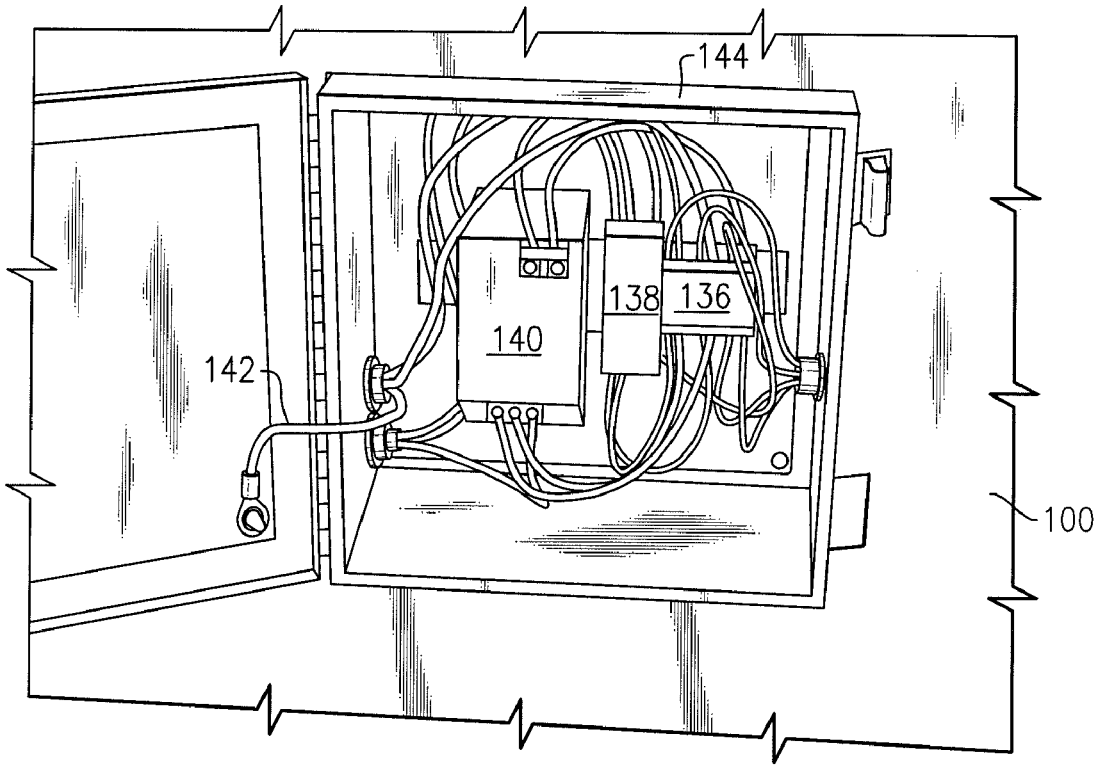
FIG. 18 is a view of the opened power supply box.
Figure 19:
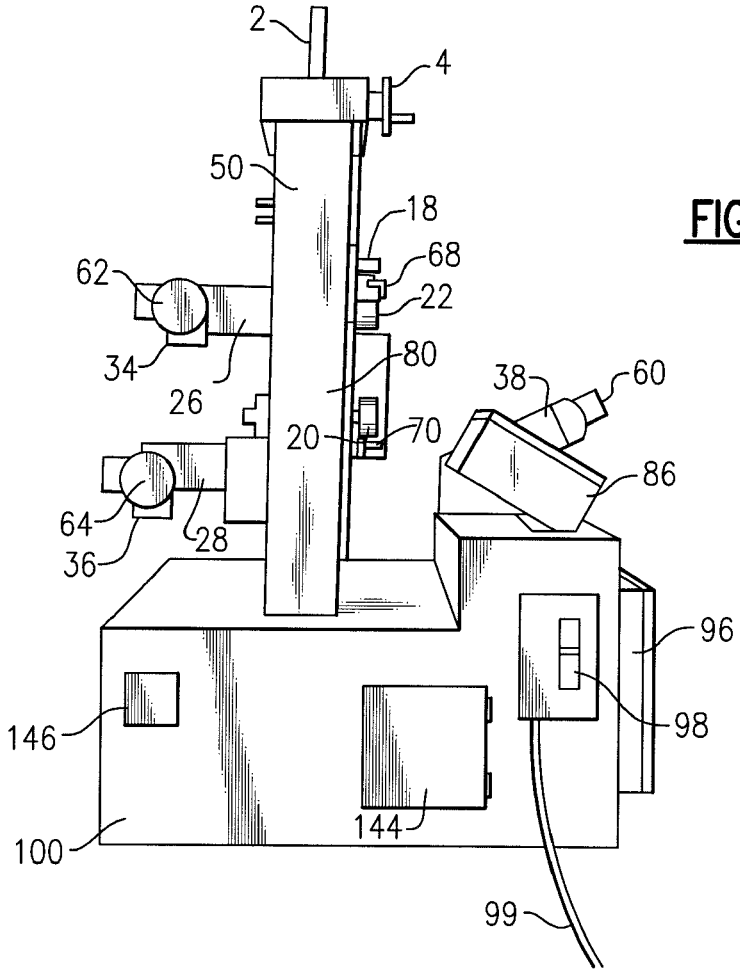
FIG. 19 is a left side view of the curving apparatus.
Figure 20:
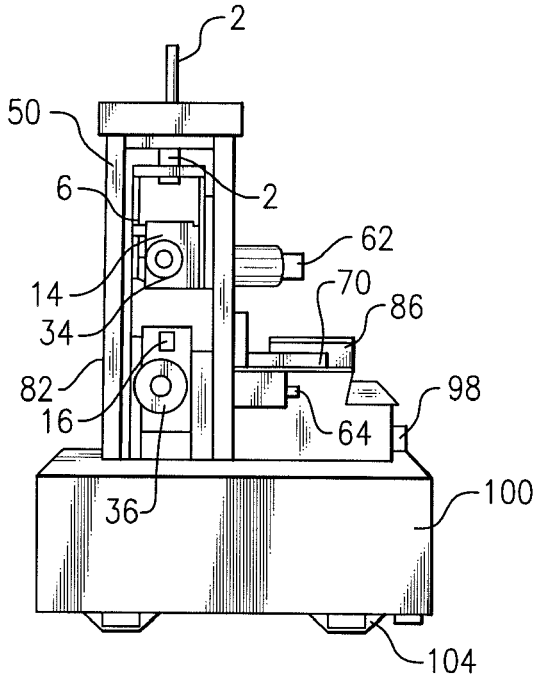
FIG. 20 is a back view of the curving apparatus.
Figure 21:
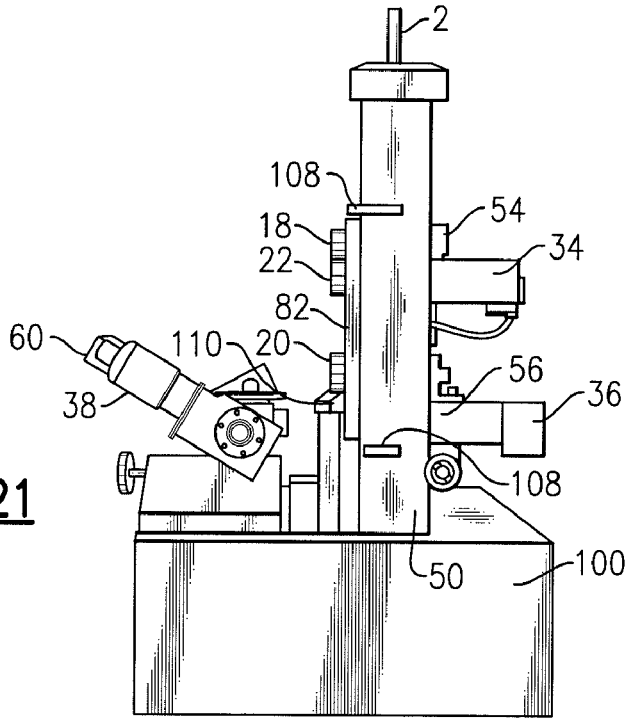
FIG. 21 is a right side view of the curving apparatus.
Figure 22:
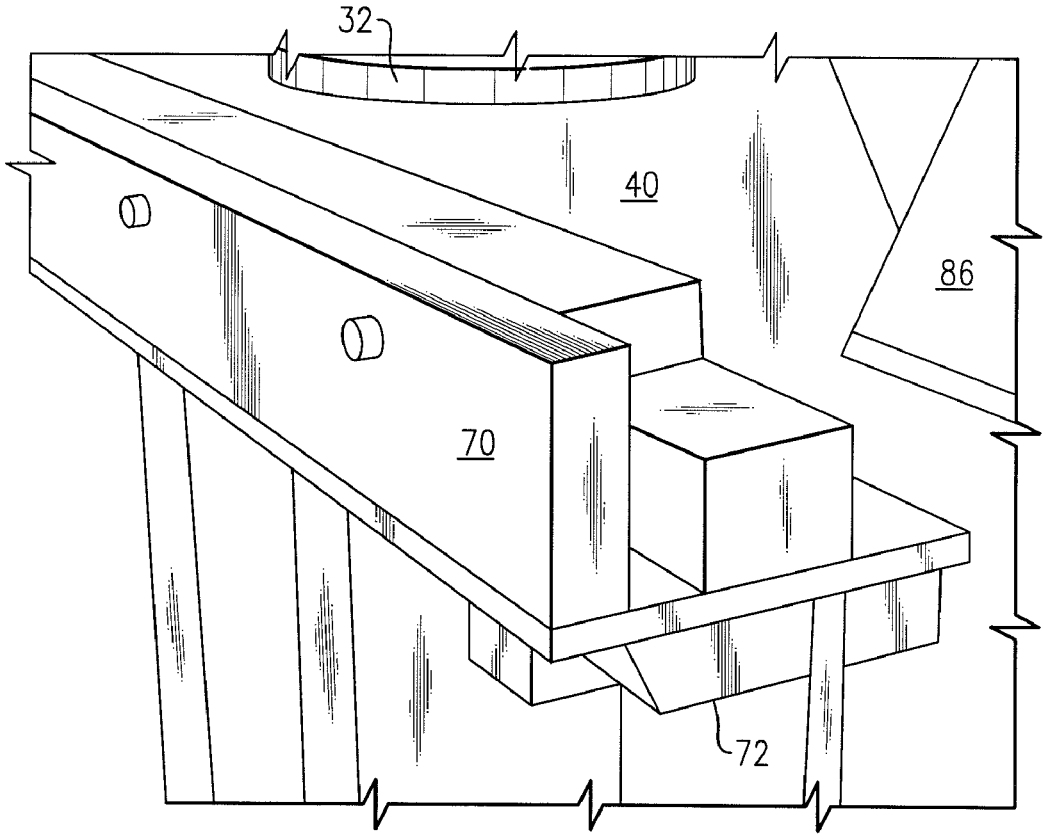
FIG. 22 is a side perspective view of the seamed metal panel P in-feed guide for Axis 2 and 3.

Power supply cabinet box 144 (FIG. 18) is conveniently disposed on the left side of the curving apparatus 1 as shown in FIG. 19, receives 110 volt electrical power from primary electrical power box 98, and provides electrical power to the frequency inverter power box 96. FIG. 18 illustrates the opened box 144 comprising terminal blocks 136 for the 110/24 volt power supply system, fuses 138 for 110/24 volt power supply system, a 24 volt 5 amp power supply 140, and cabinet door ground 142. In an alternative embodiment, 220 volt electrical power is used instead of 110 volt electrical power.

Interface control panel 86 provides for display of information and status to, and for control of various elements of the curving apparatus by, the operator (not shown). See FIG. 6 for illustration of control panel 86 and control elements. The operator may control, for example, the frequency inverters 118, 120, 122, 124 so as to control the drive motors 34, 36, 38 from the interface control panel 86, directly and/or via axis 1 drive motor encoder 62, axis 2 drive motor encoder 64, and axis 3 drive motor encoder, respectively. The operator may, for example, control and change the speed of motors 34, 36, 38 from the interface panel using motor speed/rpm control pad 88. In addition, the operator may monitor the travel or position of the LVDT sensors 8 for axis 1 and axis 2 via the LVDT sensor read-out panel 90. Data and controls for both sensors and drives may be simultaneously displayed, or the operator may toggle between axis 1 LVDT sensor 8 and axis 2 LVDT sensor 8, as desired. The operator may also monitor the power and status via power indicator lights 102. The operator may also toggle 114 between powering axis 1 and axis 2 drive motors 34, 36 (e.g., for curving "U" panels P'), or powering axes 1, 2 and 3 drive motors 34, 36, 38 (e.g., for curving seamed panels P). Electing to power axis 1 and axis 2 drive motors 34, 36 for curving "U" panels P' results in no power being applied to the axis 3 drive motor 38.

An emergency stop button 92 is also located on the control panel 86 in the event of an emergency requiring an immediate stop. Actuation of emergency stop button 92 immediately interrupts power to the drive motors 34, 36, 38 so that the curving apparatus operation immediately ceases. Additionally, or alternatively, a "dead man's switch" or other indication that an operator is not in control of the station may be implemented. Locks 106 for control panel are preferably provided to prevent operation of the curving apparatus 1 at times when desired or necessary, such as, example, for maintenance, installing material, removing material, etc.

Curving apparatus 1 also provides two 120 volt convenience outlets 146 as shown in FIG. 19.

Although, as described herein, the operation is primarily manual, that is, an operator manually sets the position of, and therefore the pressure applied by, the various wheels and axes, the process could be automated. For example, once the desired pressures are known for a panel having a particular length, width, depth, type, gauge, material, and desired curvature then these settings may be stored in a memory, for example, in a memory associated with a processor (not shown) used to implement the control panel 86. The operator may then input the information for a panel to be curved, or the operator may input a panel type, based upon the panel characteristics mentioned above. The stored setting will then be recalled and automatically applied, such as by using electric motors to adjust the various positions. Alternatively, the stored settings could be recalled to instruct the operator as to the various positions to be implemented.

In a typical use of the apparatus for curving a seamed metal panel, the operator switches on the power box 98 and then preferably waits until the system has performed a self check and power has been applied to or is ready to be applied to all necessary components. Once this occurs, a green light 102 illuminates indicating that it is acceptable to proceed.

The on/off button 112 may then be actuated to engage the master frequency inverter 118. Each slave frequency inverter (120, 122, 124) then activates individually and the motor speed/rpm control readout 88 will indicate that each frequency inverter is reading properly with either an "OK" or "ERROR" message displayed thereon and, if "OK", the systems check is complete. If "ERROR" is displayed, the operator may investigate to determine the cause of the message. If the "all OK" button 112 illuminates, then the operator may proceed. Preferably, if the "all OK" button is not illuminated, then the apparatus is locked, to prevent any motor activation, until the problem has been corrected. The master and slave inverters operate to control and synchronize the speeds of the various driving motors so that the panel is evenly and smoothly pulled though the various axes.

If the systems check out acceptably, the operator then switches on the motor toggle switch 114 so that power is ready to be applied to the axis 1, 2 and/or 3 motors (34, 36, 38, respectively).

Figure 25:
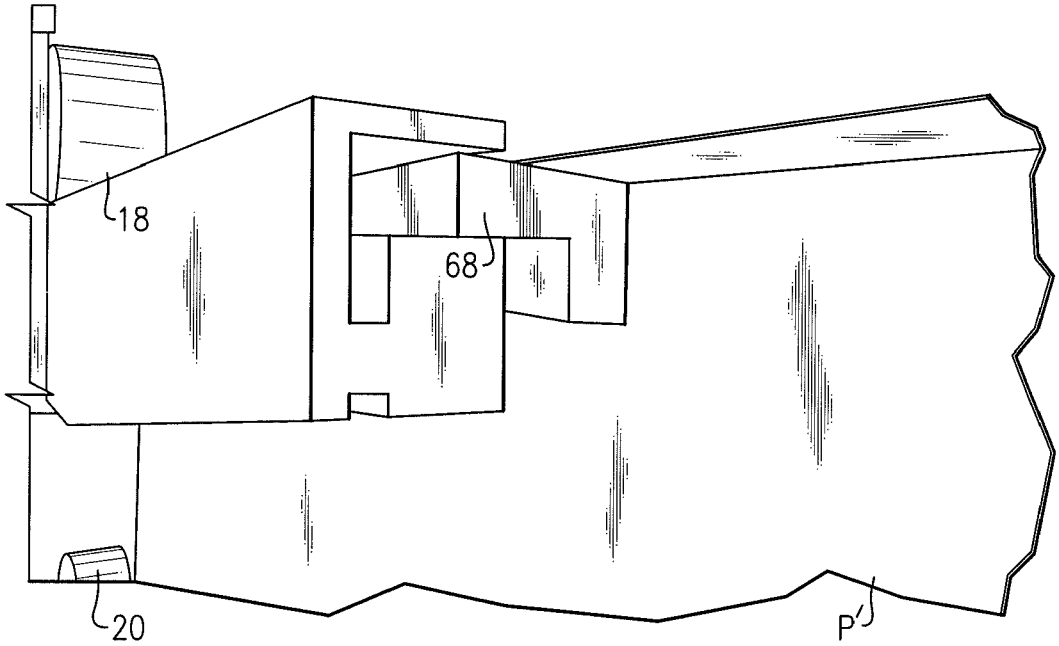
FIG. 25 is a rear perspective of Axis 1 and associated in-feed guide with the metal "U" panel.
Figure 26:
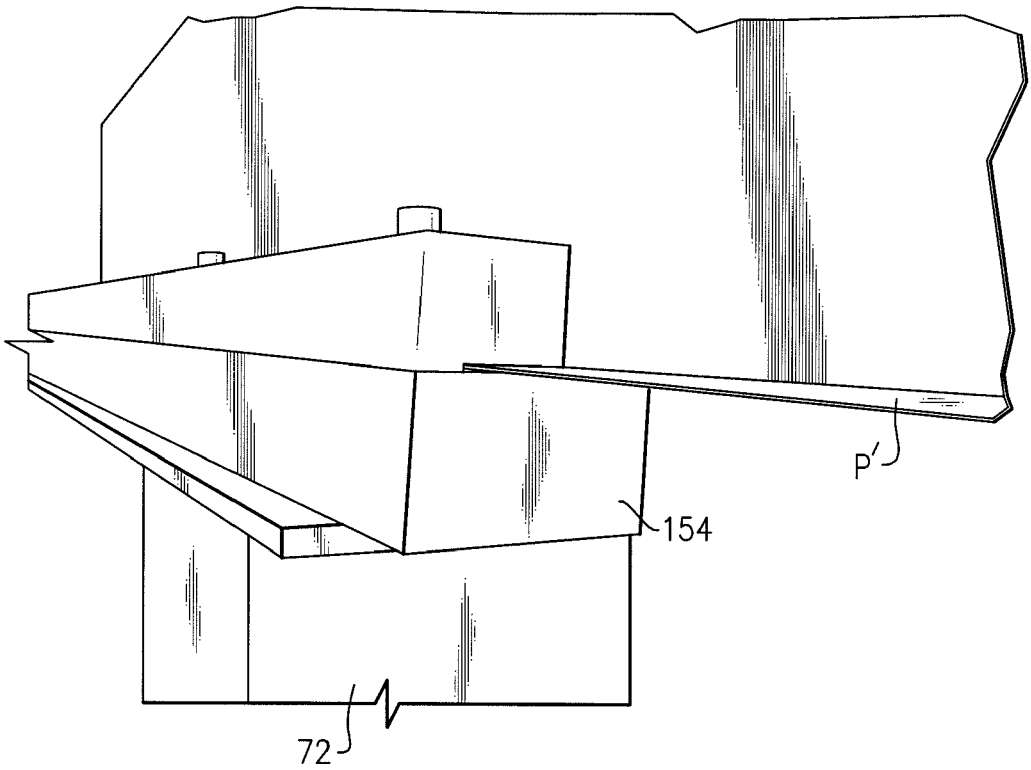
FIG. 26 is a rear perspective of Axis 2 and associated in-feed guide with the metal "U" panel.
Figure 27:
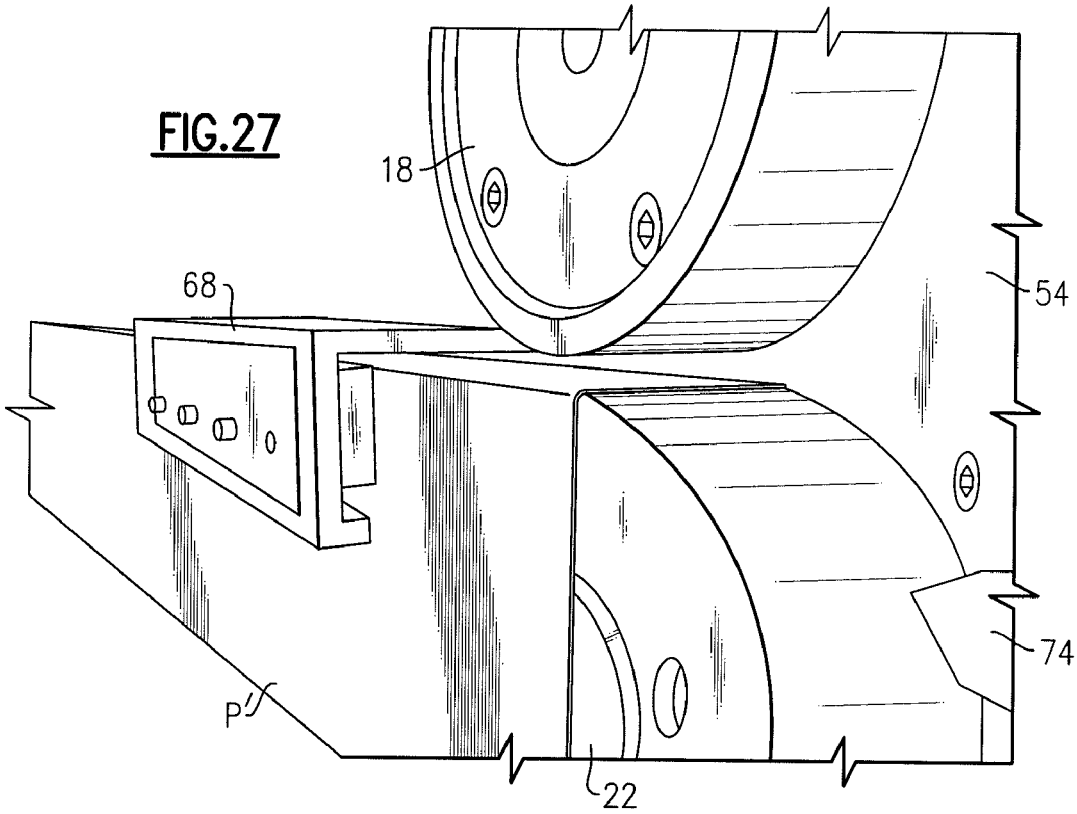
FIG. 27 is a front perspective of Axis 1 with the metal "U" panel P' disengaged.
Figure 28:
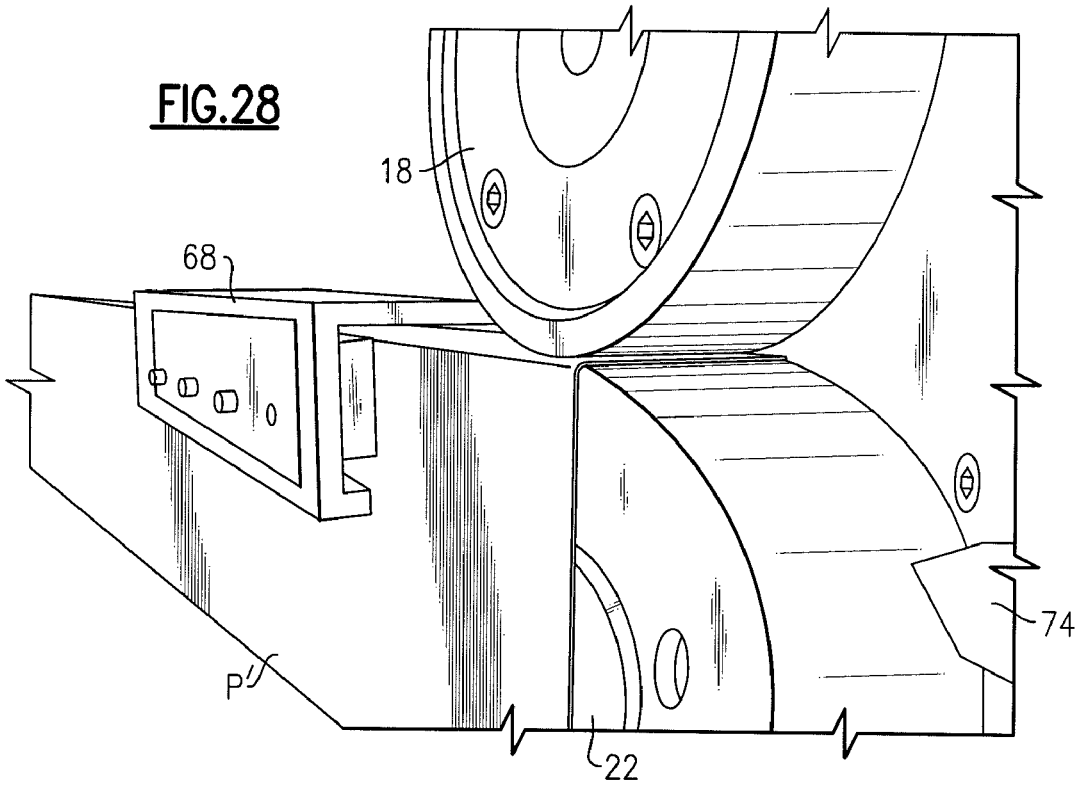
FIG. 28 is a front perspective of Axis 1 with the metal "U" panel P' engaged.

The operator then manually inserts a 2" seamed metal panel P on edge into the axis 1 in-feed guide 68 and the axis 2 in-feed guide 70. (FIGS. 5, 6, 8, 11, 14, 20 and 22.) Alternatively, another mechanism may automatically pull a panel from a feedstock supply and route it to the in-feed guides. Moreover, as illustrated in FIG. 25 (showing a 1" "U" metal panel P' guided onto in-feed guide 68), in-feed guide 68 has complimentary recesses for accepting and slidingly guiding the upper horizontal member UH, and the upper lip UL of male leg M into engagement with axis 1 wheels. Similarly, axis 2 in-feed guide 70 comprises complementary recesses for accepting and slidingly guiding the female leg F comprising of the lower horizontal member LH, vertical member V and lower lip LL into engagement with the axis 2 and 3 wheels. Thus, as the metal panel P slides into and over the in-feed guides 68, 70, it is positioned properly with respect to axes 1, 2 and 3 for further operation.

The metal panel P is urged forward over the guides 68, 70 until the leading edge reaches the approximate midpoint of axis 1 and axis 2. In other words, the metal panel P is advanced over the in-feed guides 68, 70 until the male leg M of the front or leading edge is located at least between the axis 1 pressure wheel 18 and axis 1 drive wheel 22 and the female leg F of the front or leading edge is located at least between the axis 2 pressure wheel 20 and the axis 2 drive wheel 24. When this occurs, axis 1 drive wheel 22 engages upper pocket UP of the male leg M of the metal panel P and axis 2 drive wheel 24 engages lower lip LL of the female leg F.

The operator, using hand wheel 44, manually moves the axis 3 drive/pressure wheel 32 horizontally toward metal panel P, specifically, the drive/pressure wheel 32 engages lower pocket LP of the lower female leg F of the metal panel P. In this configuration, the vertical member V of the lower female leg F is held between the drive wheel 32 and the axis 3 anvil wheel 30. The metal panel P is now positioned to allow pressure application by the axes 1, 2 and 3. (See, for example, FIGS. 7, 8, 10 and 13.)

The operator may then manually increase pressure on the upper male leg M of the metal panel P by actuating (tightening) the pressure applicator 10. This causes pressure bar 14 to pivot, which works to lower the axis 1 pressure wheel 18 onto the upper horizontal member UH, thereby pressuring the upper horizontal member UH between the axis 1 pressure wheel 18 and the axis 1 drive wheel 22. The associated LVDT sensor 8 and associated read-out panel 90 indicate the distance traveled by, or the position of, the axis 1 pressure wheel 18. The read-out panel 90 provides an indication to the operator so that, when the distance traveled by the axis 1 pressure wheel 18 has reached or is in the optimal range, the operator preferably ceases to adjust the pressure of the axis 1 pressure wheel 18.

The operator then repeats the basic manual pressure increase operation described above for the axis 2 for the lower female leg F of the metal panel P. Thus, axis 2 pressure applicator 10 is actuated and tightened, lowering (pivoting) axis 2 pressure wheel 20 toward lower horizontal member LH, pressuring the lower horizontal member LH as well as increasing the pressure between the axis 2 drive wheel 24 and the lower lip LL. The axis 2 LVDT sensor 8 indicates the distance traveled by, or the position of, the axis 2 pressure wheel 20. The operator may toggle between axis 1 and axis 2 LVDT data on the read-out panel 90. The read-out panel 90 provides an indication to the operator so that, when the distance traveled by the axis 2 pressure wheel 24 has reached or is in the optimal range, the operator preferably ceases to adjust the pressure of the axis 2 pressure wheel 24.

If curving a seamed panel, then a similar adjustment may be performed for axis 3. If curving a "U" panel, then axis 3 is not used and no adjustment is required. Pressure having been appropriately placed on axes 1, 2 (and 3 if appropriate), the vertical location of axis 1 may be adjusted to eliminate and/or remove any signs of distortion (i.e., "oil-canning") in the metal panel P or P'. If distortion is observed then axis 1 (not just wheel 18) may be raised slightly, relative to axis 2, to relieve the pressure across the pan S, S', using hand wheel 4 to actuate jack 2. Axis 1 casing 54 is mounted to a support frame which is mounted to vertical roll-on slider bearing rails 6 which are mounted to the steel up-right tubular framework 50, and is capable of moving up and down in relation to the height of the panel.

The appropriate pressure value for a desired radius is dependent upon, inter alia, the type of metal, the gauge of the metal, the width of the metal panel P, the depth, the temperature of the metal panel P and the ambient temperature. The appropriate pressure value may therefore be pre-established by routine experimentation using different pressures for a particular type of panel to determine the set of pressures, or range of pressures, that provide the desired results.

The operator may now adjust the position of the external curving bar 82. (FIGS. 3, 5, 10, 15, 16, 23, 24, 26 and 32-34.) External curving bar 82 is mounted on mounts 108 that are slotted and have numbered scales to allow determining of position of the external curving bar 82. The position of the external curving bar 82 affects the radius of the curving metal panel P and, as a result, is properly selected to achieve the desired radius. As with selection of the pressures, the appropriate position of the curving bar 82 may be pre-established by routine experimentation using positions for a particular type of panel to determine the position, or range of positions, that provides the desired results.

The positioning of the metal panel P, and the setting of the various pressures and the position of the curving bar being completed, the operator may now engage axis 1 drive motor 34, axis 2 drive motor 36, and axis 3 drive motor 38 (if appropriate). Motors 34, 36, 38 are able to operate at slow, medium, or fast speeds at the discretion of the operator, which will be dependent upon the particular task, type of metal panel and radius of curvature desired. The operator controls the speed by using the motor speed/rpm control pad 88. Although only slow, medium, or fast speeds are mentioned, it will be appreciated that more discrete speeds may be provided, or variable speeds may be provided.

Actuating the drive motors 34, 36, 38 causes the drive wheels 22, 24, 32 to operate in unison. The drive wheels 22, 24, 32 urge the metal panel P forward, e.g., moving from left to right from the operator's perspective.

As the metal panel P advances, the pressure created at axis 1, axis 2 and axis 3 as the various panel members are pulled between the wheels causes the metal of the particular member to elongate by, for example, stretching or flowing, as in a cold-rolling process, and causes little or no distortion to the panel itself.

This occurs because the panel initially has a certain thickness or gauge, but the wheels are set to a slightly smaller distance. Further, the wheels are essentially hard and unyielding as compared with the metal of the panels. Therefore, the member is forced through an opening which is slightly smaller than the gauge of the panel and, as a result, the metal of the member flows to become slightly thinner, which makes the member slightly longer. Thus, even though, for example, members UH, UL, S, LH, V and LL start having the same length, the pressure of the wheels causes the metal of members UH, LH and V to elongate. Members UL and LL are not directly elongated, but become elongated as a result of UH, UL and V being elongated. These members therefore become slightly stretched or elongated with respect to member S. As a result, the metal panel P begins to naturally curve (outwardly, toward the operator) at the desired predetermined radius.

If an even smaller radius of curvature is desired, the external curving bar 82 is used so that the leading edge of the panel engages and slides over the external curving bar 82, which thereby forces the panel into a tighter curve. External curving bar 82 thus assists in further manipulating the flow of the stretched metal, forcing the metal panel P into a smaller predetermined radius. Axis 1 exit guide 74 and axis 2 exit guide 110 located between axes 1, 2 and the external curving bar 82 have relatively smooth surfaces to provide a smooth transition for curving panel P from the axes to the curving bar 82. (FIGS. 3, 5, 7, 8, 10, 14, 16, 21, 24, 27, 28, 31, 32 and 34.)

The operator then removes the curved panel, which is now at the desired, predetermined radius. Machinery for automatically removing and stacking the curved panels may also be used. A second panel is then placed, either manually or, alternatively, automatically, in the axis 1 and axis 2 in-feed guides 68, 70 and the process repeated. FIG. 35 illustrates exemplary seamed metal panels provided by the apparatus. Two of the panels shown have the optional striations.

Figure 29:
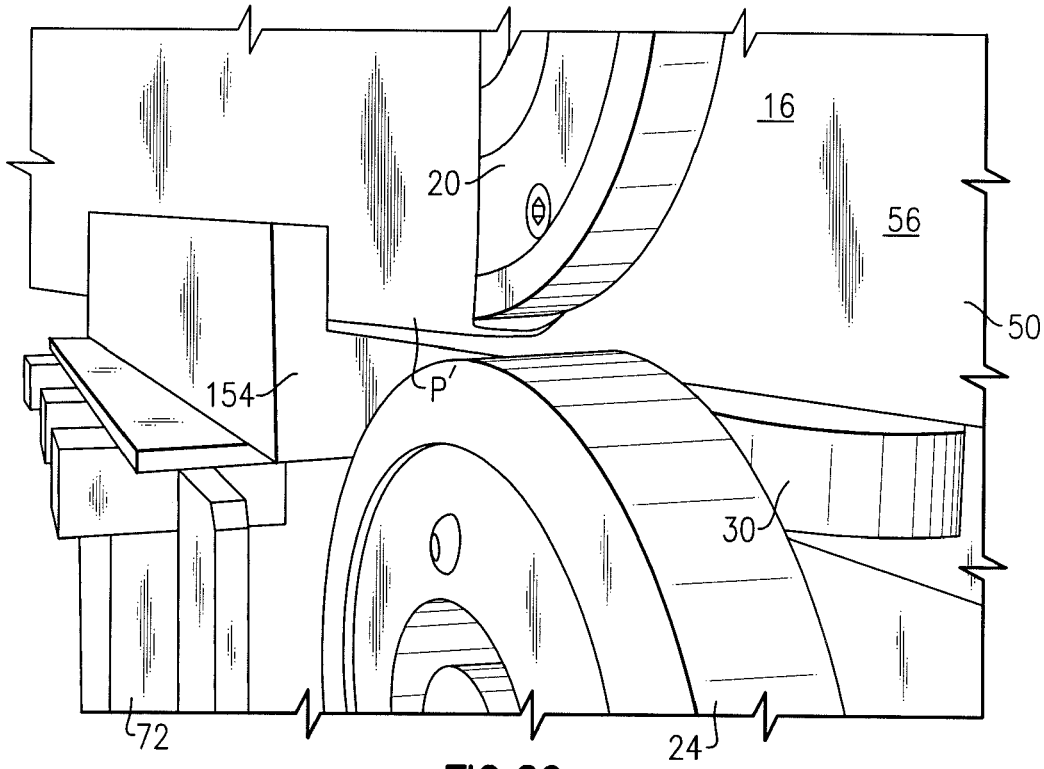
FIG. 29 is a front perspective of Axis 2 with the metal "U" panel P' disengaged.
Figure 30:
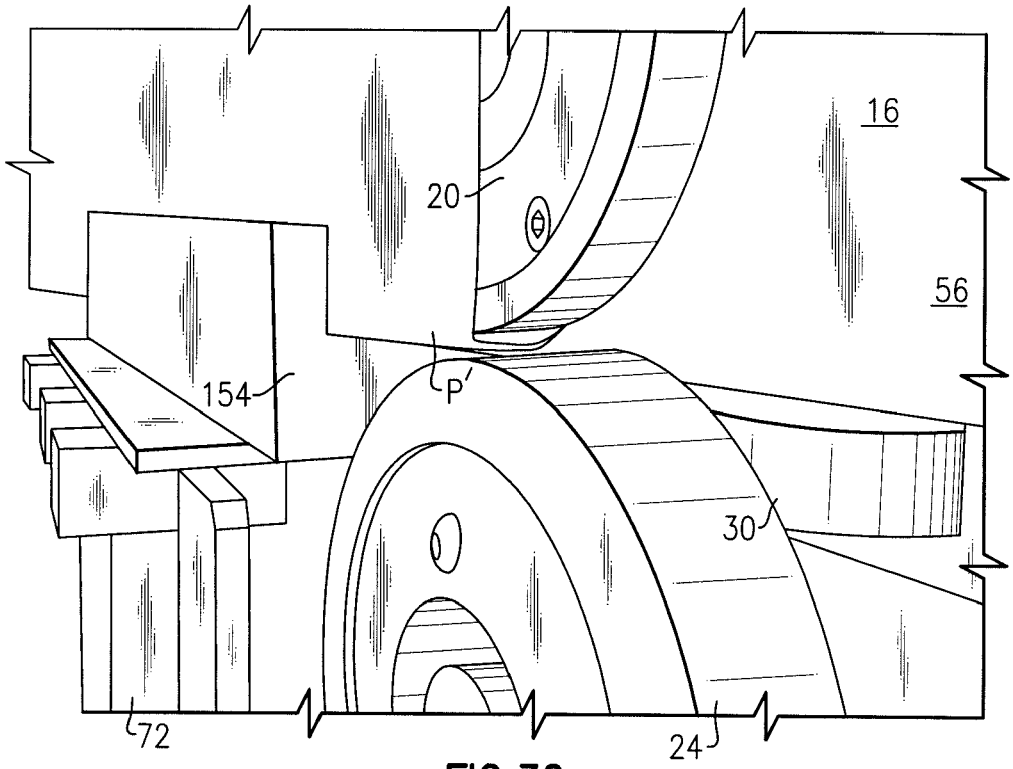
FIG. 30 is a front perspective of Axis 2 with the metal "U" panel P' engaged.
Figure 33:
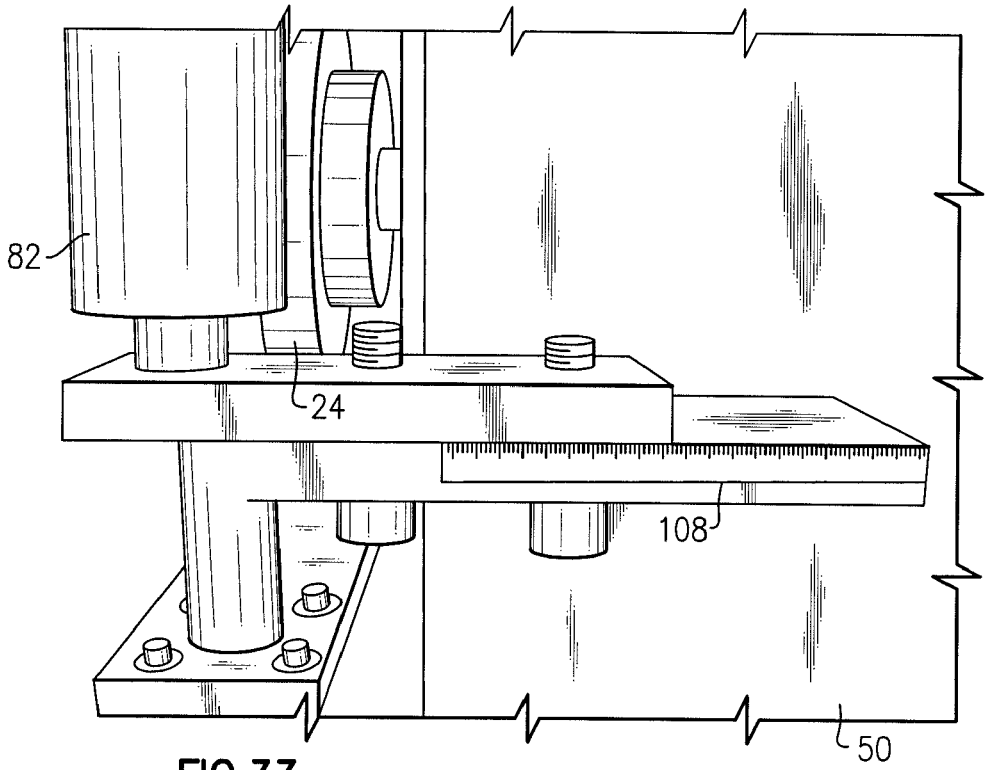
FIG. 33 is a rear view of external curving bar and bottom mounts with scale set up for the metal "U" panel P'.
Figure 34:
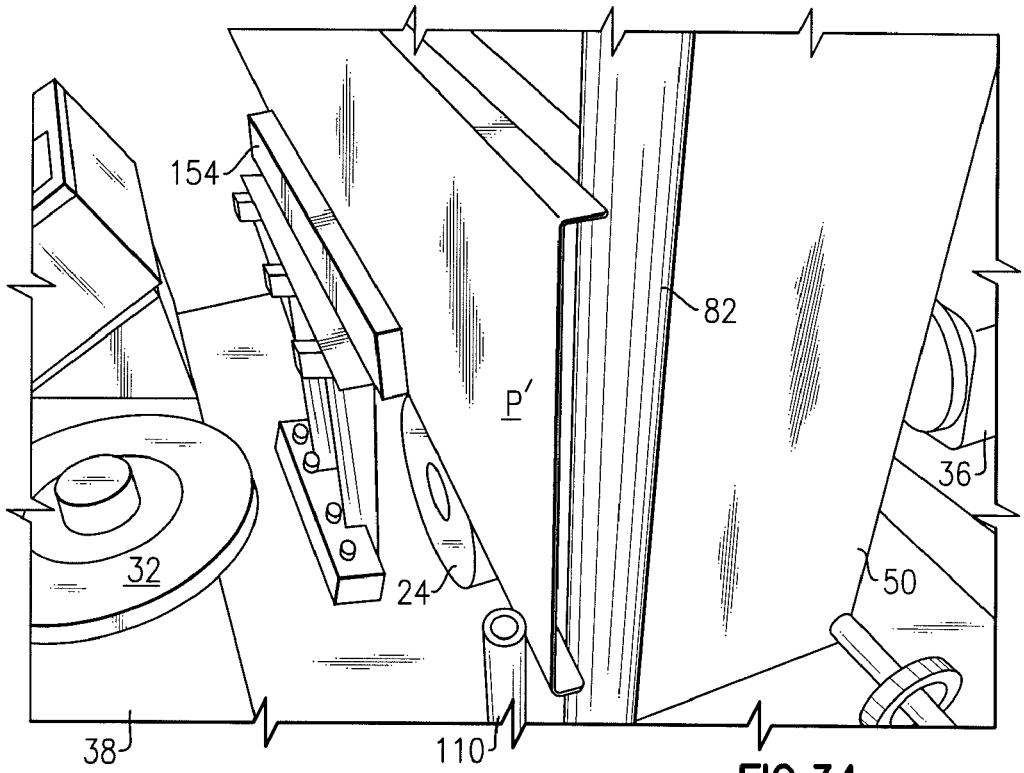
FIG. 34 is a front perspective of the metal "U" panel P' engaging external curving bar.

The method for curving a metal "U" panel P' differs primarily in that axis 3 is not used for curving panel P'. That is, only axis 1 and axis 2 are used to compress and elongate members UH' and LH'. Moreover, as illustrated in FIGS. 25 through 34, the metal "U" panel axis 1 in-feed guide 68 and axis 2 in-feed guide 154 have complimentary recesses for accepting the upper horizontal member UH' and the lower horizontal member LH', respectively, of the metal "U" panel P'. Thus, to change over from curving seamed metal panels P to "U" panels P', the axis 2 in-feed guide 70 for seamed metal panels is removed and replaced with axis 2 in-feed guide 154 for "U" panels as illustrated. Also, as shown in FIGS. 29 and 30, wheel 24 is raised so that the panel member UL' will be compressed between wheels 20 and 24, rather than wheels 20 and 32 (for member UL). Also, wheels 30 and 32 are not necessary and therefore are not used when curving panel P'. Curving bar 82 may still be used, as described above, to obtain a smaller radius of curvature for panel P'.

FIG. 36 illustrates two curved "U" panels P', each curved to a different radius.

As FIGS. 35 and 36 and the examples below illustrate, seamed metal panels may be curved down to at least a 14 foot radius and "U" panels may be curved down to at least a 3 foot radius without deformity or distortion.

The following examples of curved panels, provided by the apparatus and process described herein, are for purposes of illustration only, and are not intended to be limiting in any manner. A mechanically seamed 2" metal panel P, 10 feet long, 2 inches deep and 16 inches wide, and constructed of 24 gauge metal, was curved to a 31 foot radius using predetermined pressure settings as a guide. This radius for this type of panel was found to be reproducible, using the predetermined pressure settings, within accepted tolerances.

A mechanically seamed 2" metal panel P, 10 feet long, 2 inches deep and 16 inches wide, and constructed of 24 gauge metal, was curved to a 20 foot radius using predetermined pressure settings as a guide. This radius for this type of panel was found to be reproducible within accepted tolerances.

A mechanically seamed 2" metal panel P, 10 feet long, 2 inches deep and 16 inches wide, and constructed of 24 gauge metal, was curved to a 14 foot radius using predetermined pressure settings as a guide. This radius for this type of panel was found to be reproducible within accepted tolerances.

A 1" metal "U" panel P, 10 feet long, 1 inch deep and 12 inches wide, constructed of 24 gauge metal, was curved to a 3 foot radius using predetermined pressure settings as a guide. This radius for this type of panel was found to be reproducible within accepted tolerances.

It will be appreciated that, after reading the description herein and reviewing the accompanying figures, and although various specific embodiments and details are disclosed and discussed herein, other and various modifications and alternative embodiments are possible and may suggest themselves to one of ordinary skill in the art. For example, although specific details on construction of an automated embodiment have not been provided, the information which has been provided will readily allow one of ordinary skill in the art to automate part of all of the process and apparatus. Therefore, the scope of the present invention is to be determined only by the claims.

I claim:

1. A panel curving apparatus for imparting a desired curvature to a metal panel, the metal panel having a predetermined thickness and a substantially flat section (S), a first leg (M) extending generally perpendicular from a first edge of the flat section and a second leg (F) extending generally perpendicular from the other, second edge of the flat section, the first and second legs extending generally in the same direction, the first leg comprising a first horizontal member (UH) and a first lip member (UL), the first horizontal member extending generally perpendicular from the first edge, the first lip member (UL) extending generally perpendicular from the first horizontal member and extending generally parallel to the flat section, wherein the flat section, the first horizontal member and the first lip member form a first pocket (UP), the second leg comprising a second horizontal member (LH), a vertical member (V), and a second lip member (LL), the second horizontal member extending generally perpendicular from the second edge and generally parallel to the first horizontal member, the vertical member extending generally perpendicular from the second horizontal member and extending generally away from the first leg, the second lip member extending generally perpendicular from the vertical member and extending generally parallel to the second horizontal member and back toward the plane of the flat section, wherein the second horizontal member, the vertical member, and the second lip member form a second pocket (LP), the panel curving apparatus comprising:

a rigid frame;

a first compression device, attached to the rigid frame, and having a first wheel, an opposing second wheel, and a driver motor, the driver motor being functionally connected to and driving one of the wheels, the position of at least one of the first wheel or the second wheel being adjustable with respect to the other wheel to provide a distance between the wheels which is less than the predetermined thickness, the first wheel being positioned within the first pocket, the first horizontal member being compressed between the first wheel and the second wheel;

a second compression device, attached to the rigid frame, having a first wheel, an opposing second wheel, and a driver motor, the driver motor being functionally connected to and driving one of the wheels, the position of at least one of the first wheel or the second wheel being adjustable with respect to the other wheel to provide a distance between the wheels which is less than the predetermined thickness, the first wheel being positioned within the second pocket, the vertical member being compressed between the first wheel and the second wheel;

a third compression device, attached to the rigid frame, and having a first wheel, an opposing second wheel, and a driver motor, the driver motor being functionally connected to and driving one of the wheels, the first wheel of the second compression device being positioned between the first wheel and the second wheel of the third compression device, the position of the first wheel of the third compression device being adjustable with respect to the first wheel of the second compression device to provide a distance between the wheels which is less than the predetermined thickness, the lower horizontal member being compressed between the first wheel of the third compression device and the first wheel of the second compression device;

whereby the first horizontal member is elongated by the first compression device, the vertical member is elongated by the second compression device, and the second horizontal member is elongated by the second and third compression devices; and whereby the elongation of the first and second horizontal members and the vertical member cause the panel to curve in a predetermined direction.

2. The apparatus of claim 1, wherein at least one of the first compression device or the third compression device further comprises a bar, the bar being pivotably mounted to the frame toward one end of the bar, one of the first wheel or the second wheel of the compression device being attached at the other end of the bar.

3. The apparatus of claim 2, wherein the compression device further comprises a positioning mechanism, attached to the frame and to the bar, which sets the maximum distance between the wheels of the compression device.

4. The apparatus of claim 1, wherein the second compression device further comprises a mechanism, attached to the frame and to one of the wheels, which sets the maximum distance between the wheels of the second compression device.

5. The apparatus of claim 1, wherein at least one of the wheels of at least one of the first compression device or the third compression device is tapered.

6. The apparatus of claim 5, wherein the wheel has an outer face which generally faces away from the frame, and an inner face which generally faces toward the frame, and the outer face has a smaller diameter than the inner face.

7. The apparatus of claim 1, wherein the first compression device further comprises a bar and a positioning mechanism, the bar being pivotably mounted to the frame toward one end of the bar, the first wheel being attached at the other end of the bar, the positioning mechanism being attached to the frame and to the bar and setting the maximum distance between the wheels of the first compression device, the driver motor driving the second wheel, the first wheel having an outer face which generally faces away from the frame and an inner face which generally faces toward the frame, the outer face having a smaller diameter than the inner face;

wherein the second compression device further comprises a mechanism, attached to the frame and to the first wheel, which sets the maximum distance between the wheels of the second compression device, the driver motor driving the first wheel; and wherein the third compression device further comprises a bar and a positioning mechanism (10), the bar being pivotably mounted to the frame toward one end of the bar, the first wheel being attached at the other end of the bar, the positioning mechanism being attached to the frame and to the bar and setting the maximum distance between the wheels of the first compression device, the driver motor driving the second wheel, the first wheel having an outer face which generally faces away from the frame and an inner face which generally faces toward the frame, the outer face having a smaller diameter than the inner face.

8. The apparatus of claim 1, further comprising a curving bar and adjustable mounts, the adjustable mounts being attached to the frame, the curving bar being attached to the adjustable mounts, the mounts being adjusted to position the curving bar to receive and deflect the metal panel after at least portions of the first and second horizontal members and the vertical member have been elongated.

9. The apparatus of claim 1, further comprising a first feed guide which directs the panel to the first compression device, and a second feed guide which directs the panel to the second and third compression devices.

10. The apparatus of claim 1, wherein the panel is a first type of metal panel, and wherein a second type of metal panel has a predetermined thickness and a substantially flat section (S'), a first leg (UH') extending generally perpendicular from a first edge of the flat section and a second leg (LH') extending generally perpendicular from the other, second edge of the flat section, the first and second legs extending generally in the same direction and being generally parallel to each other, and wherein:

the first wheel of the second compression device is retractable to allow the apparatus to impart a desired curvature to the second type of metal panel;

the first leg is compressed and elongated by the wheels of the first compression device;

the second leg is compressed and elongated by the wheels of the third compression device; and whereby the elongation of the first and second horizontal members and the vertical member cause the panel of the second type to curve in a predetermined direction.

11. The apparatus of claim 1, wherein at least one of the first, second and third compression devices each further comprise at least one mechanism for adjusting at least one of pressure, alignment, gap size, and speed while the panel is in the apparatus.

12. A method for imparting a desired curvature to a metal panel, the metal panel having a predetermined thickness and a substantially flat section (S), a first leg (M) extending generally perpendicular from a first edge of the flat section and a second leg (F) extending generally perpendicular from the other, second edge of the flat section, the first and second legs extending generally in the same direction, the first leg comprising a first horizontal member (UH) and a first lip member (UL), the first horizontal member extending generally perpendicular from the first edge, the first lip member (UL) extending generally perpendicular from the first horizontal member and extending generally parallel to the flat section, wherein the flat section, the first horizontal member and the first lip member form a first pocket (UP), the second leg comprising a second horizontal member (LH), a vertical member (V), and a second lip member (LL), the second horizontal member extending generally perpendicular from the second edge and generally parallel to the first horizontal member, the vertical member extending generally perpendicular from the second horizontal member and extending generally away from the first leg, the second lip member extending generally perpendicular from the vertical member and extending generally parallel to the second horizontal member and back toward the plane of the flat section, wherein the second horizontal member, the vertical member, and the second lip member form a second pocket (LP), the method comprising:

compressing and elongating the first horizontal member (UH);

compressing and elongating the vertical member (V) by exerting horizontal pressure on the vertical member (V); and compressing and elongating the second horizontal member (LH) by exerting vertical pressure on the second horizontal member (LH), whereby the panel is caused to curve in a predetermined direction.

13. The method of claim 12, wherein compressing and elongating comprises forcing the first and second horizontal members and the vertical member through respective openings which are less than the predetermined thickness of the panel.

14. The method of claim 12, wherein compressing and elongating comprises forcing the first horizontal member between two wheels which are separated by a distance which is less than the predetermined thickness of the panel, forcing the second horizontal member between two wheels which are separated by a distance which is less than the predetermined thickness of the panel, and forcing the vertical member between two wheels which are separated by a distance which is less than the predetermined thickness of the panel.

15. The method of claim 14, wherein the forcing of the first and second horizontal members and the vertical members is done essentially simultaneously.

16. The method of claim 14, further comprising driving at least one of the wheels which compress the first horizontal member, driving at least one of the wheels which compress the second horizontal member, and driving at least one of the wheels which compress the vertical member, whereby the first and second horizontal members and the vertical member are forced between their respective wheels.

17. The method of claim 12, wherein additional curvature is imparted to the panel by urging the panel against a curving bar after at least portions of the first and second horizontal members and the vertical member have been elongated.

18. The method of claim 12, wherein the compression and elongation occurs only at the first horizontal member, the vertical member and the second horizontal member and no substantial compression or elongation occurs with the remaining portions of the panel.

19. The method of claim 12, wherein the method further comprises adjusting at least one of the first, second and third compression devices while in operation with respect to at least one of pressure, alignment, gap size and speed.

20. A panel curving apparatus for imparting a desired curvature to a metal panel, the metal panel having a predetermined thickness and a substantially flat section (S), a first leg (M) extending generally perpendicular from a first edge of the flat section and a second leg (F) extending generally perpendicular from the other, second edge of the flat section, the first and second legs extending generally in the same direction, the first leg comprising a first horizontal member (UH) and a first lip member (UL), the first horizontal member extending generally perpendicular from the first edge, the first lip member (UL) extending generally perpendicular from the first horizontal member and extending generally parallel to the flat section, wherein the flat section, the first horizontal member and the first lip member form a first pocket (UP), the second leg comprising a second horizontal member (LH), a vertical member (V), and a second lip member (LL), the second horizontal member extending generally perpendicular from the second edge and generally parallel to the first horizontal member, the vertical member extending generally perpendicular from the second horizontal member and extending generally away from the first leg, the second lip member extending generally perpendicular from the vertical member and extending generally parallel to the second horizontal member and back toward the plane of the flat section, wherein the second horizontal member, the vertical member, and the second lip member form a second pocket (LP), the panel curving apparatus comprising:

a rigid frame;

a first compression device, attached to the rigid frame, and having a first wheel, an opposing second wheel, and a driver motor, the driver motor being functionally connected to and driving one of the wheels, the position of at least one of the first wheel or the second wheel being adjustable with respect to the other wheel to provide a distance between the wheels which is less than the predetermined thickness, the first wheel being positioned within the first pocket, the first horizontal member being compressed between the first wheel and the second wheel; and, a second compression device, attached to the rigid frame, and having a first wheel, an opposing second wheel, and a driver motor, the driver motor being functionally connected to and driving one of the wheels, whereby the first horizontal member is elongated by the first compression device, and the second horizontal member is elongated by the second compression device, and whereby the elongation of the first and second horizontal members cause the panel to curve in a predetermined direction.

* * * * *